United States Patent [19]

Boden et al.

[11] 4,330,425

[45] May 18, 1982

[54] USE OF MIXTURE OF ALIPHATIC $C_{10}$ BRANCHED OLEFIN EPOXIDES IN AUGMENTING OR ENHANCING THE AROMA OF ARTICLES SUBJECTED TO ACTION OF AQUEOUS HYPOCHLORITES

[75] Inventors: Richard M. Boden, Monmouth Beach; Lambert Dekker, Wyckoff; Frederick L. Schmitt, Holmdel, all of N.J.; Augustinus G. Van Loveren, Rye, N.Y.

[73] Assignee: International Flavors & Fragrances Inc., New York, N.Y.

[21] Appl. No.: 231,773

[22] Filed: Feb. 27, 1981

Related U.S. Application Data

[63] Continuation-in-part of Ser. No. 195,630, Oct. 9, 1980, which is a continuation-in-part of Ser. No. 160,788, Jun. 19, 1980, Pat. No. 4,287,084.

[51] Int. Cl.[3] ..... C11D 7/54; C11D 3/395; C11D 3/50

[52] U.S. Cl. ..... 252/187 H; 252/95; 252/99; 252/174.11; 252/522 R; 8/108 R; 8/108 H

[58] Field of Search ..... 252/187 H, 95, 99, 174.11, 252/522 R; 8/108 H, 108 R

[56] References Cited

U.S. PATENT DOCUMENTS

| | | | |
|---|---|---|---|
| 3,684,722 | 8/1972 | Hynam et al. | 252/187 H |
| 4,113,645 | 9/1978 | DeSimone | 252/187 H |
| 4,123,377 | 10/1978 | Davey et al. | 252/187 H |
| 4,208,297 | 6/1980 | Light et al. | 252/522 R |

*Primary Examiner*—Irwin Gluck
*Attorney, Agent, or Firm*—Arthur L. Liberman

[57] ABSTRACT

Described are methods for augmenting or enhancing the aroma of articles subjected to the action of aqueous hypochlorite bleach compositions by adding perfume aroma augmenting or enhancing quantities of aliphatic $C_{10}$-branched olefin epoxide-containing mixtures produced by dimerizing isoamylene, (2-methyl-2-butene) and then epoxidizing the resulting product to aqueous alkali metal hypochlorite bleach compositions containing a stabilizing and emulsifying quantity of at least one compound having the structure:

wherein at least one of $R_1$ and $R_2$ represents $C_{10}$–$C_{12}$ branched or straight chain alkyl and when one of $R_1$ or $R_2$ is $C_{10}$–$C_{12}$ branched or straight chain alkyl, the other of $R_1$ or $R_2$ is hydrogen and wherein $M_\alpha$ and $M_\beta$ are the same or different and each represents alkali metal which may be either sodium, potassium or lithium and aqueous bleaching compositions containing such dimerized isoamylene epoxide derivative(s), alkali metal hypochlorites and at least one compound having the structure:

wherein $R_1$, $R_2$, $M_\alpha$ and $M_\beta$ are defined as above.

5 Claims, 17 Drawing Figures

GLC PROFILE FOR EXAMPLE A.

GLC PROFILE FOR EXAMPLE A

GLC PROFILE FOR EXAMPLE A.

GLC PROFILE FOR EXAMPLE A.
DISTILLATION PRODUCT

GLC PROFILE FOR EXAMPLE A.
CRUDE PRODUCT

FIG.2A
NMR SPECTRUM FOR PEAK I OF EXAMPLE A, OF GLC OF FIG.AE
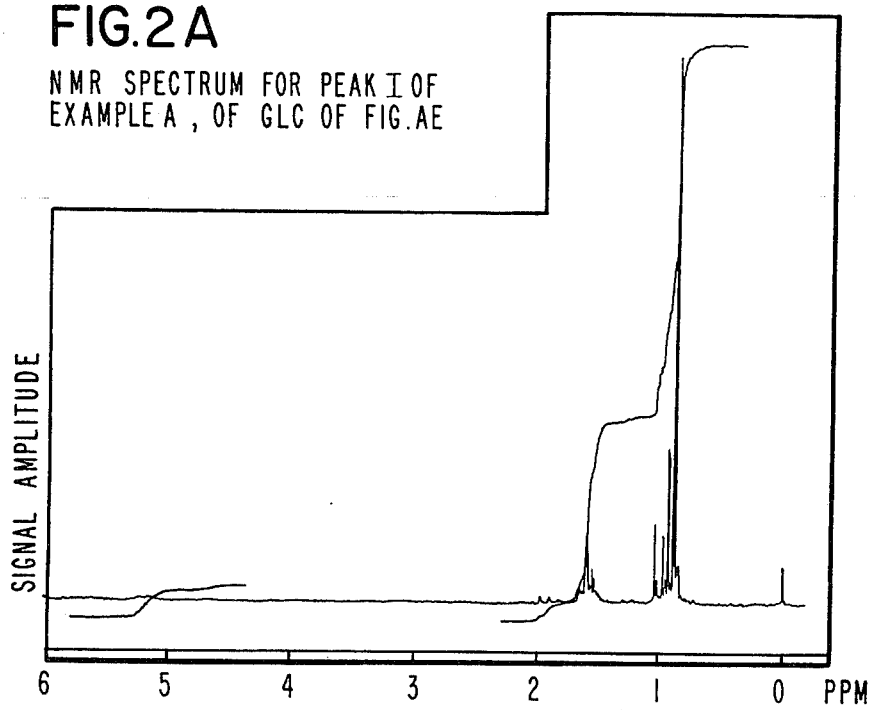
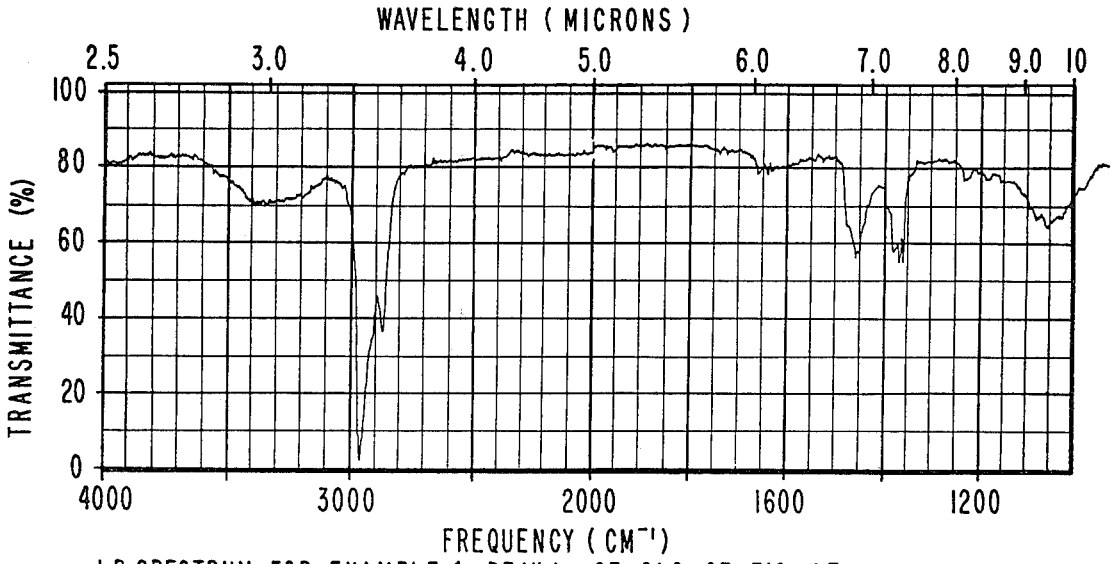
IR SPECTRUM FOR EXAMPLE A, PEAK I, OF GLC OF FIG. AE.
FIG.2B FIG. 3A
NMR SPECTRUM FOR EXAMPLE A, PEAK 2, OF GLC OF FIG. AE
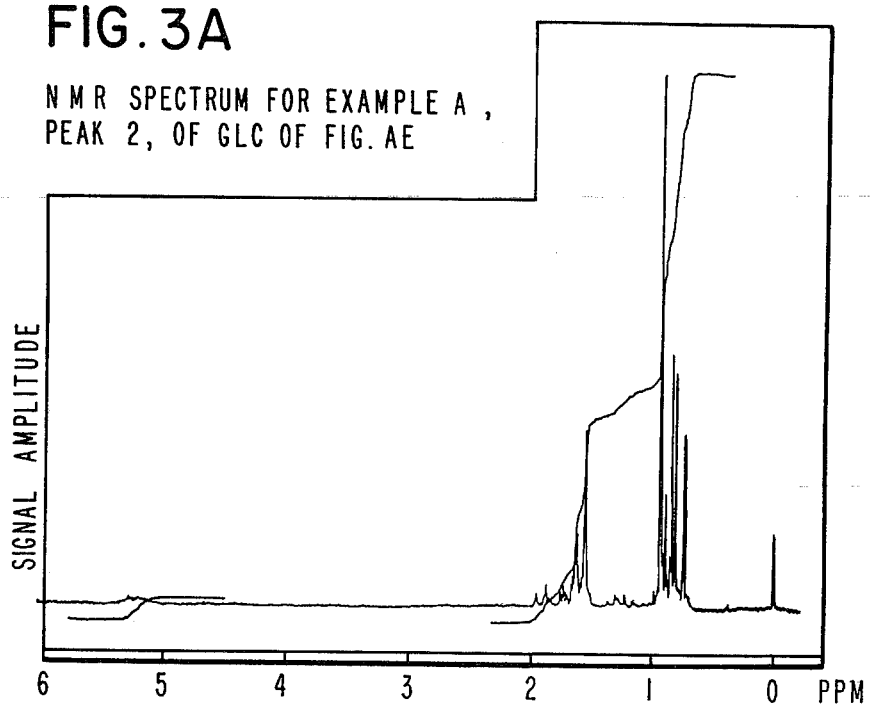
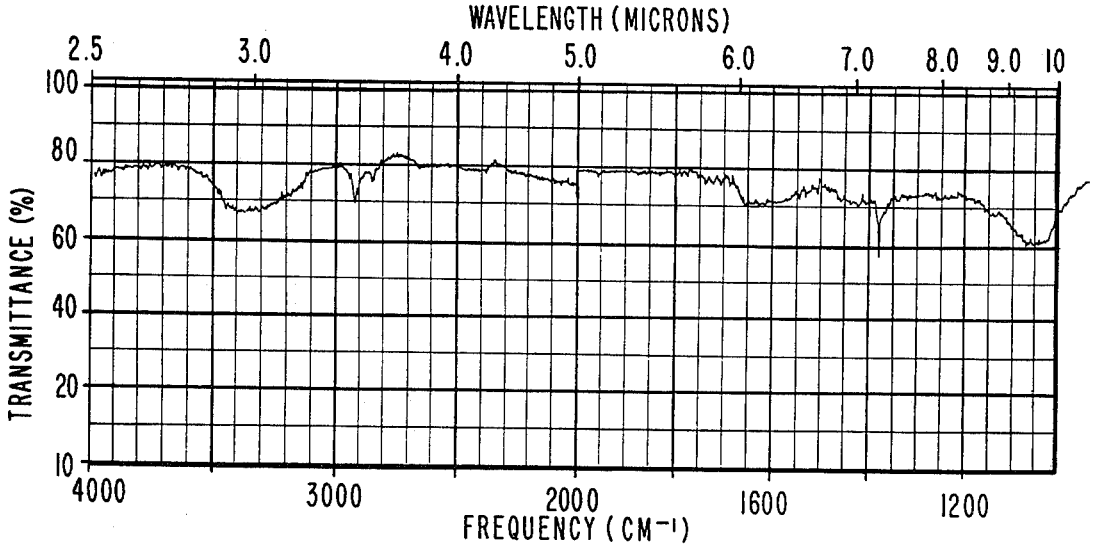
IR SPECTRUM FOR EXAMPLE I, PEAK 2 OF GLC OF FIG. AE
FIG. 3B FIG. 4
NMR SPECTRUM FOR PEAK 2 OF EXAMPLE I, OF GLC OF FIG. AB.
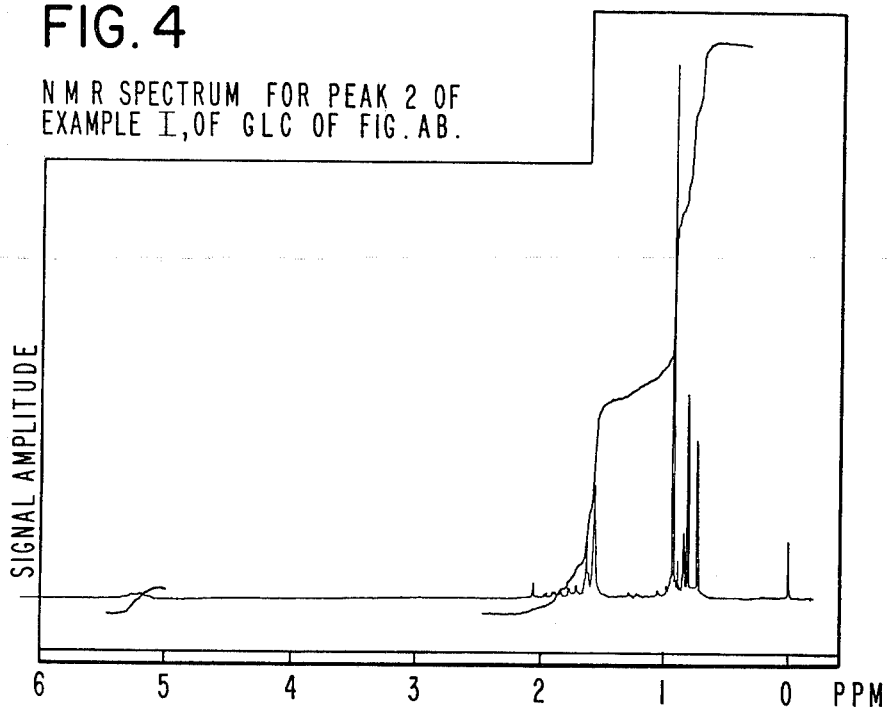
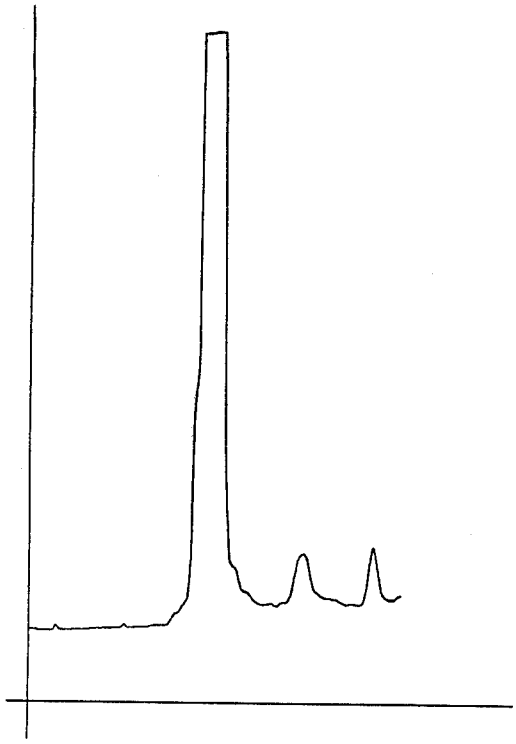
GLC PROFILE FOR EXAMPLE II.
FIG. 5

FIG. 6
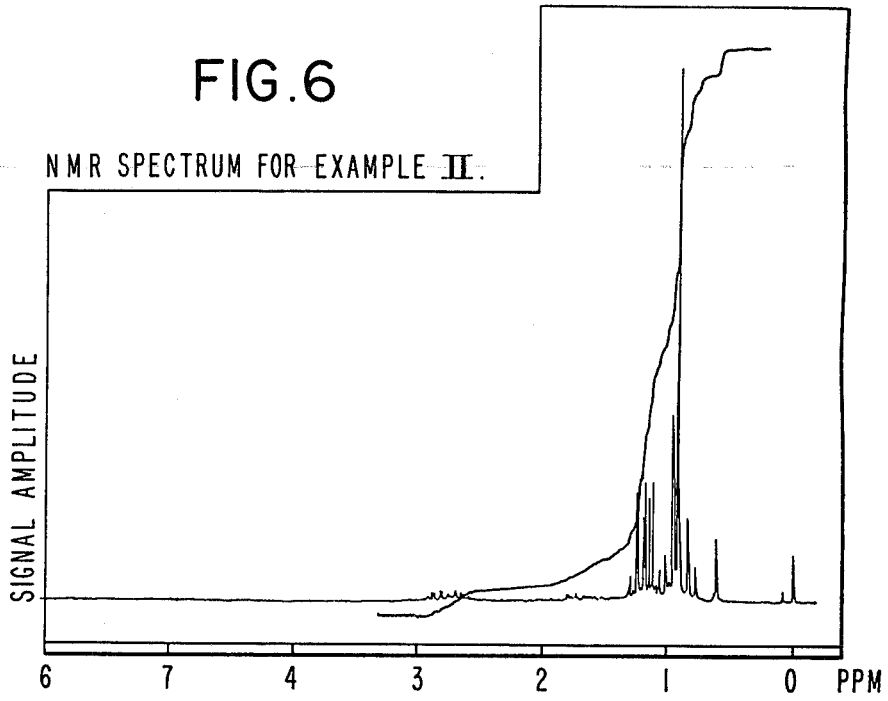
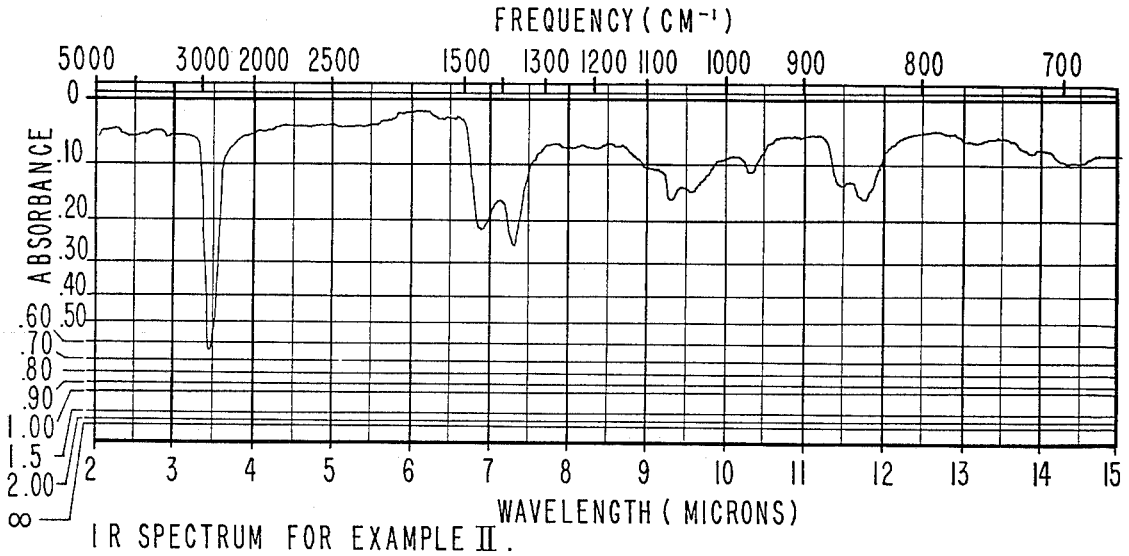
FIG. 7

EXAMPLE XXII.

EXAMPLE XXII

EXAMPLE XXII

BLANK-NO SURFACTANT AND NO FRAGRANCE

AROMOX:DIISOAMYLENE EPOXIDE:BASE 0.8:0.2:9

DOWFAX:DIISOAMYLENE EPOXIDE:BASE 0.8:0.2:9

AROMOX:DIISOAMYLENE EPOXIDE:BASE 1.8:0.2:9

DOWFAX:DIISOAMYLENE EPOXIDE:BASE 1.8:0.2:9

EXAMPLE XXII.

BLANK - NO SURFACTANT AND NO FRAGRANCE

DOWFAX: DIISOAMYLENE EPOXIDE: BASE 3.8:0.2:9

DOWFAX: DIISOAMYLENE EPOXIDE: BASE 3.8:0.2:9

AROMOX: BASE 3.8:96 NO DIISOAMYLENE EPOXIDE.

DOWFAX: BASE 3.8:96 NO DIISOAMYLENE EPOXIDE.

USE OF MIXTURE OF ALIPHATIC $C_{10}$ BRANCHED OLEFIN EPOXIDES IN AUGMENTING OR ENHANCING THE AROMA OF ARTICLES SUBJECTED TO ACTION OF AQUEOUS HYPOCHLORITES

This application is a Continuation-in-Part of application for U.S. Letters Patent, Ser. No. 195,630, filed on Oct. 9, 1980, which, in turn, is a Continuation-in-Part of application for U.S. Letters Patent, Ser. No. 160,788, filed on June 19, 1980 now U.S. Pat. No. 4,287,084.

BACKGROUND OF THE INVENTION

The instant invention provides mixtures of $C_{10}$ branched chain olefin epoxides which are used to augment or enhance the aroma of articles (e.g. clothing) subjected to the bleaching action of aqueous hypochlorite solutions subsequent to the drying of said articles after being subjected to such bleaching action. The instant invention also covers hypochlorite compositions which comprise aqueous hypochlorite, the said $C_{10}$ branched chain olefin epoxides and one or more compounds having the generic structure:

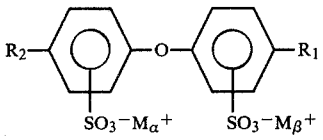

wherein at least one of $R_1$ and $R_2$ represents $C_{10}$–$C_{12}$ branched or straight chain alkyl and when one of $R_1$ or $R_2$ is $C_{10}$–$C_{12}$ branched or straight chain alkyl, the other of $R_1$ or $R_2$ is hydrogen; and wherein $M_\alpha$ and $M_\beta$ are the same or different and each represents sodium, potassium or lithium, said $C_{10}$–$C_{12}$ moieties being either straight chain or branched chain, for example, having the structures:

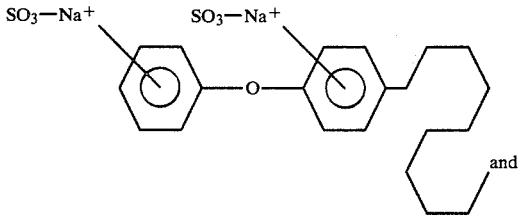

and

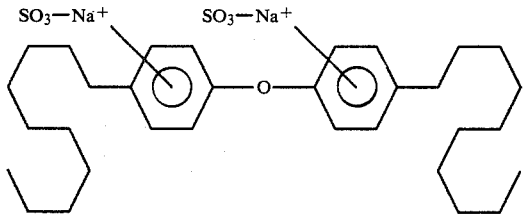

wherein the $SO_3^-Na^+$ groups are at various positions on the phenyl moieties.

Chemical compounds which can provide woody, eucalyptol-like and minty aromas are desirable in the art of perfumery as well as in hypochlorite bleaches which include such perfuming materials. Many of the natural materials which provide such fragrances and contribute such desired nuances to perfumery compositions are high in cost, unobtainable at times, vary in quality from one batch to another, are unstable in aqueous hypochlorite bleaches, and/or are generally subject to the usual variations of natural products.

There is, accordingly, a continuing effort to find synthetic materials which will replace, enhance or augment the fragrance notes provided by certain natural essential oils or compositions thereof, particularly where perfumery materials which are stable in hypochlorite bleach compositions are desired. Unfortunately, many of the synthetic materials either have the desired nuances only to a relatively small degree, or they contribute undesirable or unwanted odor to the compositions and their stability, in most instances, is relatively low in the presence of aqueous hypochlorite bleaching solutions.

Aliphatic hydrocarbons are well known in the art of perfumery, e.g. myrcene, 2-methyl-6-methylene-2,7-octadiene, a constituent of lemon grass oil. Also found in lemon oil as well as in Bergamot oil, according to Gildemeister and Hoffmann, (Die Atherischen Ole, 3rd edition, Volume 1, page 301) is octylene, a long chain olefin containing eight carbon atoms.

Arctander, "Perfume and Flavor Chemicals, (Aroma Chemicals)", 1969, Vol. I, at monograph 974, discloses the use of "di-isoprene" in perfumery. Arctander states that di-isoprene is a mixture of 2,6-dimethyl-2,6-octadiene; 2,7-dimethyl-2,6-octadiene; and 3,6-dimethyl-2,6-octadiene. Arctander states that this material has a sweet, diffusive, somewhat "gassy" odor and, overall, is of very "little interest to the perfumer." At monograph 1074, Arctander discloses "dipentene" having a use in perfumery and indicates that this "dipentene" is 1-methyl-4-iso-propenyl-1-cyclohexene and indicates that it is useful in perfumery as a "lift" in citrusy fragrances and in the reconstruction of many essential oils such as Bergamot, Lime and Lemon.

U.S. Pat. No. 3,896,180 issued on July 22, 1975 discloses the use in perfumery of the cyclic diene epoxide having the structure:

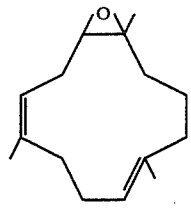

particularly for its woody, amber odor.

Other mono-epoxidized products of tri-methylcyclododecatriene are disclosed in U.S. Pat. No. 3,723,478 issued on Mar. 27, 1973. The uses in perfumery of such materials are also disclosed in said U.S. Pat. No. 3,723,478.

U.S. Pat. No. 3,333,010 issued on July 25, 1957 discloses epoxycyclododecadiene having the structure:

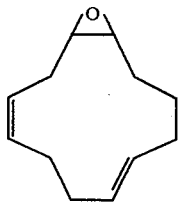

Nothing in the prior art discloses the use in conjunction with aqueous hypochlorite bleaching agents and with compounds having the generic structure:

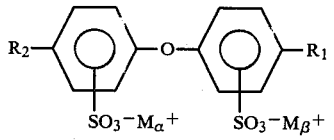

wherein one or both of $R_1$ or $R_2$ is branched or straight chain $C_{10}$–$C_{12}$ alkyl and if one of $R_1$ or $R_2$ is $C_{10}$–$C_{12}$ straight or branched chain alkyl, the other of $R_1$ or $R_2$ is hydrogen and wherein $M_\alpha$and $M_\beta$are the same or different and each is sodium, lithium or potassium, of diisoamylenes epoxides defined according to the generic structure:

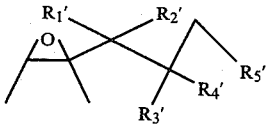

which would be produced from branched chain olefins having the generic structure:

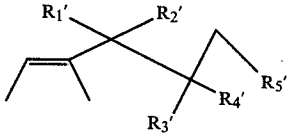

wherein $R_1'$, $R_2'$, $R_3'$, $R_4'$ and $R_5'$ are the same or different and each represents hydrogen or methyl with the proviso that (i) the sum total of carbon atoms in $R_1'$, $R_2'$, $R_3'$, $R_4'$ and $R_5'$ is three, and (ii) $R_1'$ and $R_2'$ represents hydrogen when $R_5$ represents methyl, and (iii) when either $R_1'$ or $R_2'$ is methyl, $R_5'$ is hydrogen, the epoxide compounds being represented by the structures:

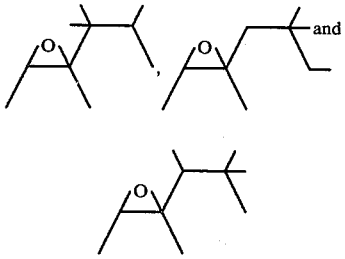

Furthermore, considerable difficulties have heretofore been encountered in using such compounded hypochlorite bleach or sterilizing solutions with perfumed oils so that a stable longlasting single phase commercially feasible bleach or sterilizing solution has been difficult to obtain, particularly wherein the desired aroma of the article bleached or sterilized (e.g. clothing) has a woody, eucalyptol-like and/or minty faint aroma on drying (and not the usual "hypochlorite-bleached-article" aroma). The problem has been defined in United Kingdom Patent Specification No. 886,084, published on Jan. 3, 1962 wherein it is stated that a stable "dispersion" of hypochlorite-resistant perfume in aqueous solutions of hypochlorites was formulated. United Kingdom Patent Specification No. 886,084 discloses the preparation of an aqueous "solution" of a hypochlorite containing a hypochlorite resistant perfume and a surface active quaternary ammonium compound of the betaine type soluble in the hypochlorite solution. Such ammonium compounds have the generic structure:

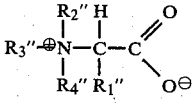

wherein each of $R_1''$, $R_2''$, $R_3''$ and $R_4''$ are alkyl. One of the features of the perfumed solutions produced in accordance with said United Kingdom Patent Specification No. 886,084 is indicated to be that the solution exhibits foaming properties. Another feature of United Kingdom Patent Specification No. 886,084 is stated to be that the perfumed solutions covered by the patent are found to be clear and homogeneous after eight weeks of storage at room temperature. Nevertheless, betaines such as "Ambiteric D" as are discussed therein are not so broadly useful when used in concentrations of from 0.15% up to 4.0% (based on total weight of bleach or sterilizing solution) as to have the ability to be used in conjunction with woody, eucalyptol-like or minty types of perfume oils which should be incorporated into hypochlorite bleaches or sterilizers so that long lasting stable soluble single phase perfumed aqueous alkali metal hypochlorite bleach or sterilizing solutions having woody or eucalyptol-like or minty long lasting stable aromas are obtained, particularly where the quantity of perfume oil in the bleach or sterilizing substance is at levels of between 0.02% and 0.8% by weight of the total bleach or sterilizing solution. The need for the "woody", "eucalyptol-like" or "minty" aromas to be present in such bleach or sterilizing solutions exists so that the disagreeable characteristic "hypochlorite" aroma is substantially eliminated from aromas of the product to which the bleach or sterilizing solution is applied; particularly on dry-out, as well as from the aroma of the hands of the user when they are in direct contact with such bleach or sterilizing solutions.

U.S. Pat. No. 3,560,389 also discloses the feasibility of using perfume oils in hypochlorite bleaches or sterilizers at column 3, lines 37–40 but the disclosure is limited to inclusion of various detergents in addition to amine oxides, such as lithium lauryl sulfate and sodium lauryl ether sulfate and/or is further limited to include hydrotropes such as sodium xylene sulfonate in addition to the amine oxide. Exclusion of such hydrotropes and detergents additional to the amine oxides and diphenyl oxide derivatives of our invention is desirable not only to cause the perfume oils (which have the desired "eucalyptol-like" or "woody" or "minty" aromas) to function properly, but also from an ecological standpoint.

European Chemical News, Volume 13, Jan. 18, 1968, sets forth a synopsis of South African Pat. No. 67/4667 which corresponds to U.S. Pat. No. 3,560,389, but the reference also states at page 42:

"Alternatively, a detergent with bleaching or bacteriocidal properties can be formulated. Perfuming bleaching solutions is now possible."

Neither the South African nor the United States patents, however, indicate the advantages and usefulness of limiting the detergents either to (a) compounds having the generic structure:

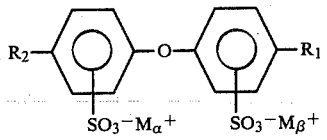

wherein at least one of $R_1$ and $R_2$ represents $C_{10}$–$C_{12}$ straight chain or branched chain alkyl and when one of $R_1$ or $R_2$ is $C_{10}$–$C_{12}$ branched or straight chain alkyl, the other or $R_1$ or $R_2$ is hydrogen and wherein $M_\alpha$ and $M_\beta$ are the same or different and each represents alkali metal which may be sodium, lithium or potassium, or (b) to mixtures of compounds having the structure:

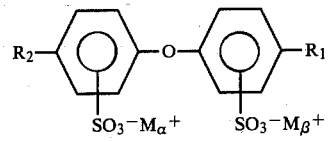

with at least one amine oxide defined according to the structure:

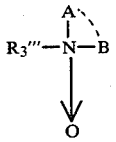

of excluding from the formulation a hydrotrope or of specifying the nature of the perfume oil useful in the perfumed bleach or sterilizing solution (wherein A and B are each separately methyl or taken together, complete a morpholino ring and wherein $R_3'''$ is straight chain alkyl having from 11 up to 13 carbon atoms).

U.S. Pat. No. 3,876,551 in attempting to solve the foregoing problem discloses a stable single phase aqueous alkali metal hypochlorite liquid perfume bleach or sterilizing composition comprising an aqueous mixture of (1) an amine oxide composition consisting essentially of at least one morpholino and/or diethyl ($C_{11}$–$C_{13}$ straight chain alkyl) amine oxide in an amount greater than 55% of said amine oxide composition, (2) at least one alkali metal hydroxide, (3) at least one alkali metal hypochlorite, and (4) a perfume oil compatible with the mixture capable of imparting a "woody" or a "floral" or a "clean fresh" or a "musk" or a "citrusy" note to the bleach or sterilizing composition; the mixture having a pH in the range of from 12 to 13.5 and the mixture excluding hydrotropes as well as all surfactants except the amine oxide. U.S. Pat. No. 3,876,551 also attempts to solve the foregoing problem by disclosing a process for producing the above-name mixture comprising the steps of combining an amide oxide composition consisting essentially of one or more morpholino and/or dimethyl $C_{11}$–$C_{13}$ straight chain alkyl amine oxide(s) with the perfumed oil to form an amine oxide-perfume oil premix; admixing the amine oxide-perfume oil premix with an aqueous alkali metal hypochlorite solution, and combining an alkali metal hydroxide with the solution whereby the final pH of the mixture is from 12 up to 13.5. In a further effort to solve the foregoing problem U.S. Pat. No. 3,876,551 also discloses adjustment of the pH of the aqueous metal hypochlorite solution initially to the range of 12–13.5 and then combining the resulting pH-adjusted aqueous hypochlorite solution with the aforementioned premix. The resulting composition is indicated to cause products to which said composition is applied to have eliminated therefrom the disagreeable characteristic "hypochlorite" aroma and instead to have a "clean fresh" or "floral" or "woody" or "musk" or "citrusy" aroma to be imparted to the treated products. In addition, it is stated that the hands of the individual user after using and being in direct contact with the hypochlorite composition will not have the disagreeable characteristic "hypochlorite" aroma but instead will have a pleasant "clean fresh" or "floral" or "woody" or "musk" or "citrusy" aroma.

The disadvantage of the system of U.S. Pat. No. 3,876,551 however, concerns the relatively low degree of chemical stability and substantive stability of the perfume oil and of the single liquid phase system. Nothing in U.S. Pat. No. 3,876,551 indicates such a high degree of stabilities of the perfume-hypochlorite system as exists in the system of the present invention. Indeed, the stabilities using the system of the instant invention are far greater even at levels as low as 3% hypochlorite and are also relatively stable (from a standpoint of chemical stability of perfume oil, substantive stability of perfume oil and phase separation stability taken in combination with one another) at levels of as high as 10% hypochlorite in aqueous solution. Thus, the instant system gives rise to unexpected, unobvious and advantageous properties over the systems taught in the prior art.

Furthermore, nothing in the prior art including the teaching of U.S. Pat. No. 3,876,551 states either explicitly or implicitly the compatability of a thickener in the instant system, such as sodium palmitate, sodium stearate, potassium palmitate, potassium stearate, lithium palmitate, lithium stearate, lithium laurate, potassium laurate or sodium laurate whereby a stable gel (as opposed to a liquid) phase perfumed hypochlorite system or perfumed oil stabilizer emulsifier system "premix" may be produced.

The combination of the compound group having the structure:

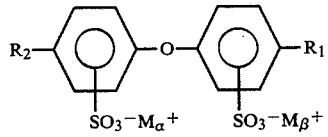

(wherein $R_1$, $R_2$, $M_\alpha$ and $M_\beta$ are defined, supra) with perfume and hypochlorite bleach in general, is set forth in the Kao Soap Company, Japanese Pat. No. 25514/79 filed on Nov. 2, 1973 and opened for public inspection on June 19, 1975. Thus, on page 2, at column 4, line 15, the compound:

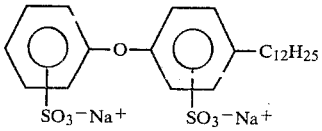

is disclosed for use in conjunction with the perfumed hypochlorite bleaches. The claim of the Kao Soap Patent is as follows:

CLAIM: An aromatic liquid bleaching composition containing, as active ingredient, sodium hypochlorite, which comprises one or more of simple perfumes or compounded perfumes selected from the group consisting of anisole, benzophenone, benzylphenyl ether, bromelia, cedrenyl acetate, p-tertiary butylcyclohexanol, dimethylbenzylcarbinyl acetate, dihydroterpinyl acetate, diphenyl oxide, dimethylbenzylcarbinol, dimethylphenylcarbinol, dihydroterpineol, fenchyl acetate, fenchyl alcohol, p-methyldimethylbenzylcarbinol, methylphenylcarbinyl acetate, methyl-n-valerate, muskmoskene, muscarone, methylamyl ketone, phenylethyldimethylcarbinyl acetate, rose phenone, styrallyl propionate, tetra hydromuguol, tetra hydromuguyl acetate, tetrahydrolinalool, tetrahydrolinalyl acetate, verool, velveton, verdox, coniferan and yarayara, and a surface active agent which can stably be dissolved in an aqueous solution of sodium hypochlorite.

Furthermore, the use of such compounds as those having the structure:

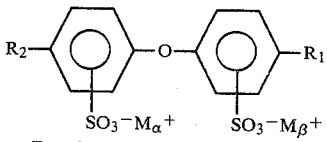

(wherein $R_1$, $R_2$, $M_\alpha$ and $M_\beta$ have been previously defined) with hypochlorite bleaches is documented in the brochure of Dow Chemical entitled "DOWFAX Surfactants" and is covered in the Dow Chemical Company U.S. Pat. No. 3,172,861 issued on Mar. 9, 1965.

Nothing in the prior art discloses, however, the utility of the diisoamylene epoxide mixture or individual compounds of the instant application taken together with one of the compounds defined according to the generic structure:

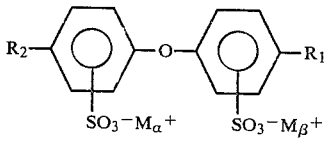

(wherein $R_1$, $R_2$, $M_\alpha$ and $M_\beta$ have been defined, supra) in hypochlorite bleaches, particularly where the hypochlorite concentration is greater than 7%. More particularly, nothing in the prior art discloses the use of such systems in conjunction with a thickener such as sodium palmitate, potassium palmitate, sodium stearate, potassium stearate, sodium laurate, potassium laurate lithium laurate, lithium stearate or lithium palmitate, whereby a stable gelled perfumed hypochlorite mixture is formed or whereby a "premix" gel-phase perfume oil-stabilizing/emulsifying agent is formed.

Di-isoamylene is indicated to be synthesized in the following references:

i—Murphy & Lane, Ind. Eng. Chem., Prod. Res. Dev., Vol. 14, No. 3, 1975 p. 167 (Title: Oligomerization of 2-Methyl-2-Butene is Sulfuric Acid and Sulfuric-Phosphoric Acid Mixtures).

ii—Whitmore & Mosher, Vol. 68, J. Am. Chem. Soc. February, 1946, p. 281 (Title: The Depolymerization of 3,4,5,5-Tetramethyl-2-hexene and 3,5,5-Trimethyl-2-heptene in Relation to the Dimerization of Isoamylenes)

iii—Whitmore & Stahly, Vo. 67, J. Am. Chem. Soc., December, 1945, p. 2158 (Title: The Polymerization of Olefins. VIII The Depolymerization of Olefins in Relation to Intramolecular Rearrangements. II)

iv—U.S. Pat. No. 3,627,700, issued on Dec. 14, 1971, (Zuech)

v—U.S. Pat. No. 3,538,181, issued on Nov. 3, 1970, (Banks)

vi—U.S. Pat. No. 3,461,184, issued on August 12, 1969 (Hay, et al)

vii—Gurwitsch, Chemische Berichte, 1912, Vol. 2, p. 796 (Production of Di-isoamylene From Isoamylene Using Mercury Acetate Catalyst)

United Kingdom Pat. No. 796,130 published on June 4, 1958 discloses the synthesis of polyalkylindanes by means of, interalia, reacting alpha-methylstyrene with trimethylene (2-methylbutene-2) in the presence of an acid catalyst such as sulfuric acid or boron trifluoride diethyletherate. It is further indicated that such compounds are useful intermediates in the production of perfumery compounds. Apparently, however, the more volatile di-isoamylenes produced as side-products in the reaction of 2-methyl-butene-2 with alpha-methylstyrene are discarded.

BRIEF DESCRIPTION OF THE DRAWINGS

FIG. 2A represents the NMR spectrum for Peak 1 of the GLC profile of FIG. 1E.

FIG. 2B represents the infra-red spectrum for Peak 1 of the GLC profile of FIG. 1E.

FIG. 3A represents the NMR spectrum for Peak 2 of the GLC profile of FIG. 1E.

FIG. 3B represents the infra-red spectrum for Peak 2 of the GLC profile of FIG. 1E.

FIG. 4 represents the NMR spectrum for Peak 2 of the GLC profile of FIG. 1B.

FIG. 5 is the GLC profile of the reaction product of Example II containing the compounds having the structures:

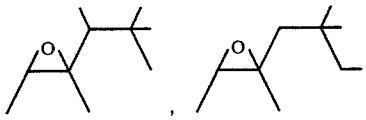

and

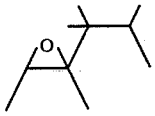

FIG. 6 is the NMR spectrum for the reaction product of Example II containing the compounds having structures:

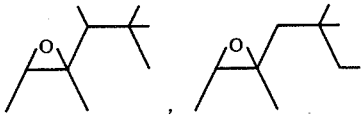

and

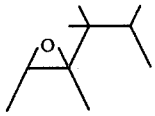

FIG. 7 is the infra-red spectrum for the reaction product of Example II containing the compounds having the structures:

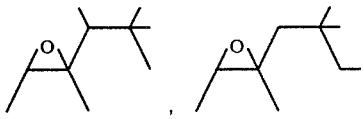

and

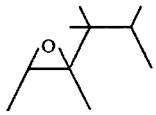

Figure 8A:
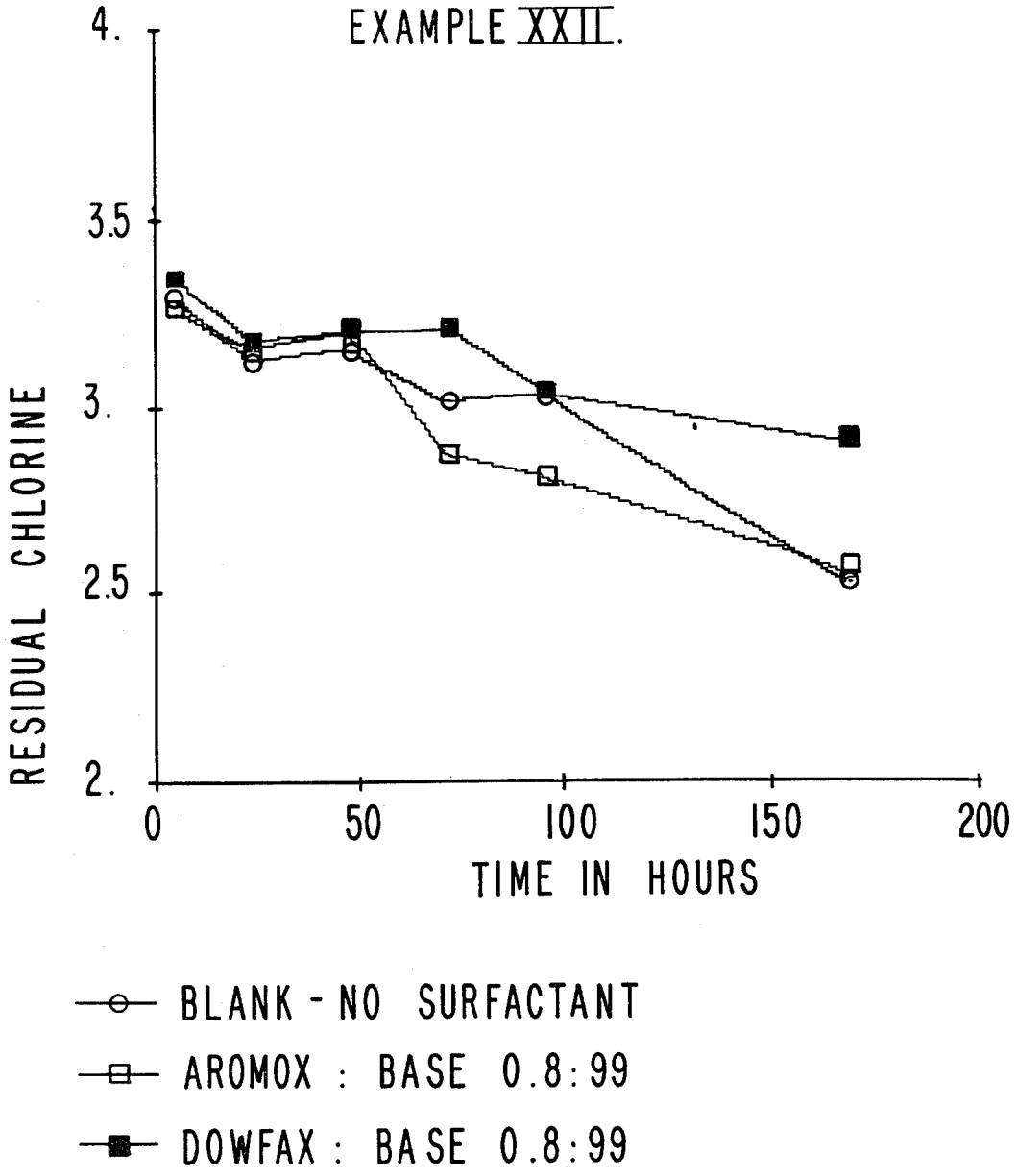

FIG. 8A represents a graph of percent residual chlorine versus time in hours for hypochlorite solutions containing either (i) DOWFAX® 2Al (a registered trademark of the Dow Chemical Company of Midland, Michigan) identifying a mixture of compounds defined according to the structure:

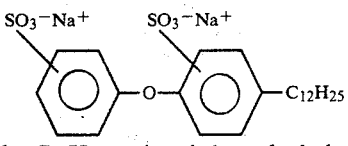

(wherein the $C_{12}H_{25}$ moiety is branched chain and the $SO_3-Na+$ moieties are at various positions on the benzene ring) or (ii) AROMOX® DMMC-W, a 30% aqueous solution of dimethylcocoamine oxide having the structure:

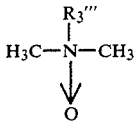

(wherein $R_3'''$ is defined infra) a trademark of Akzo Corporation of Chicago, Illinois (product produced by Armac, Division of Akzo Corporation of Chicago, Illinois) with the weight ratio of AROMOX® DMMC-W:base being 0.8:99 and the ratio of DOWFAX® 2Al:base being 0.8:99, as described in Example XXII, infra.

Figure 8B:
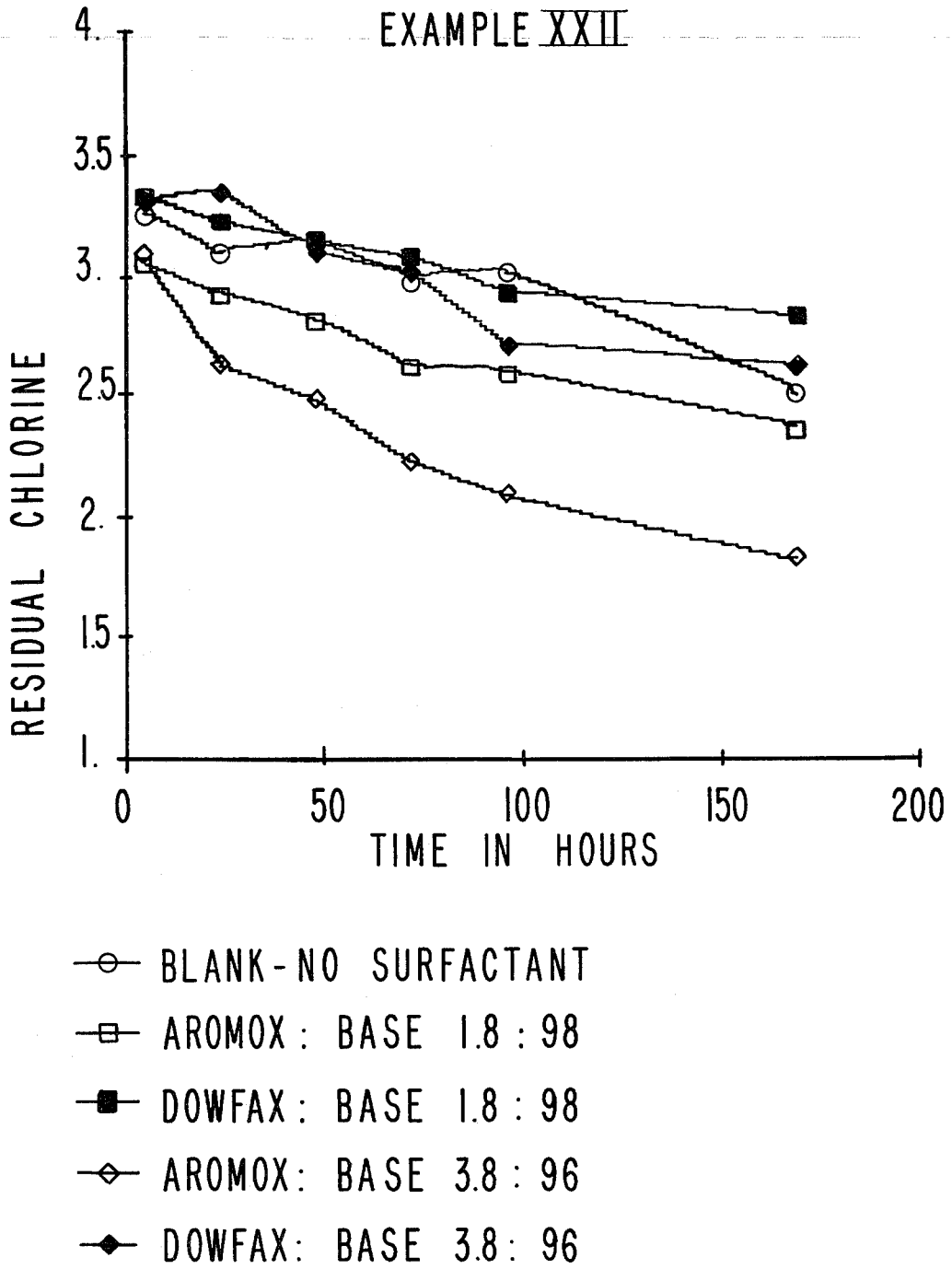

FIG. 8B is a graph of percent residual chlorine versus time in hours for hypochlorite solutions of either (i) DOWFAX® 2Al or (ii) AROMOX® DMMC-W, in the absence of fragrance or essential oils with the weight ratio of AROMOX® DMMC-W:base being 1.8:99 and 3.8:96 and the ratios of DOWFAX® 2Al:-base being 1.8:99 and 3.8:99, as described in Example XXII, infra.

Figure 9A:
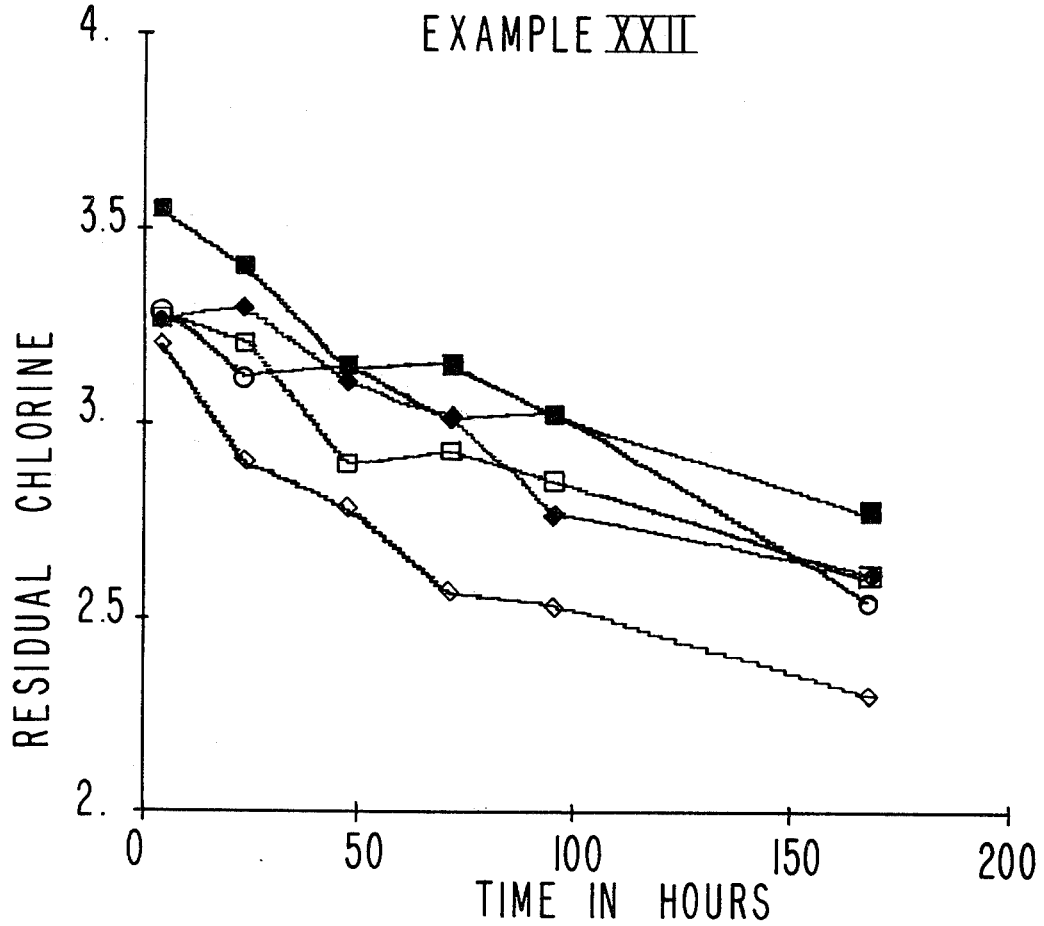

FIG. 9A is a graph of percent residual chlorine versus time in hours comparing the hypochlorite solutions of DOWFAX® 2Al versus (ii) AROMOX® DMMC-W, with the perfuming material being one of the diisoamylene epoxide products produced according to Example II, infra, wherein the weight ratio of AROMOX® DMMC-W:diisoamylene epoxide:base is either 0.8:0.2:9 or 1.8:0.2:9 and the weight ratio of DOWFAX® 2Al:-diisoamylene epoxide:base is 0.8:0.2:9 or 1.8:0.2:9, as described in Example XXII, infra.

Figure 9B:
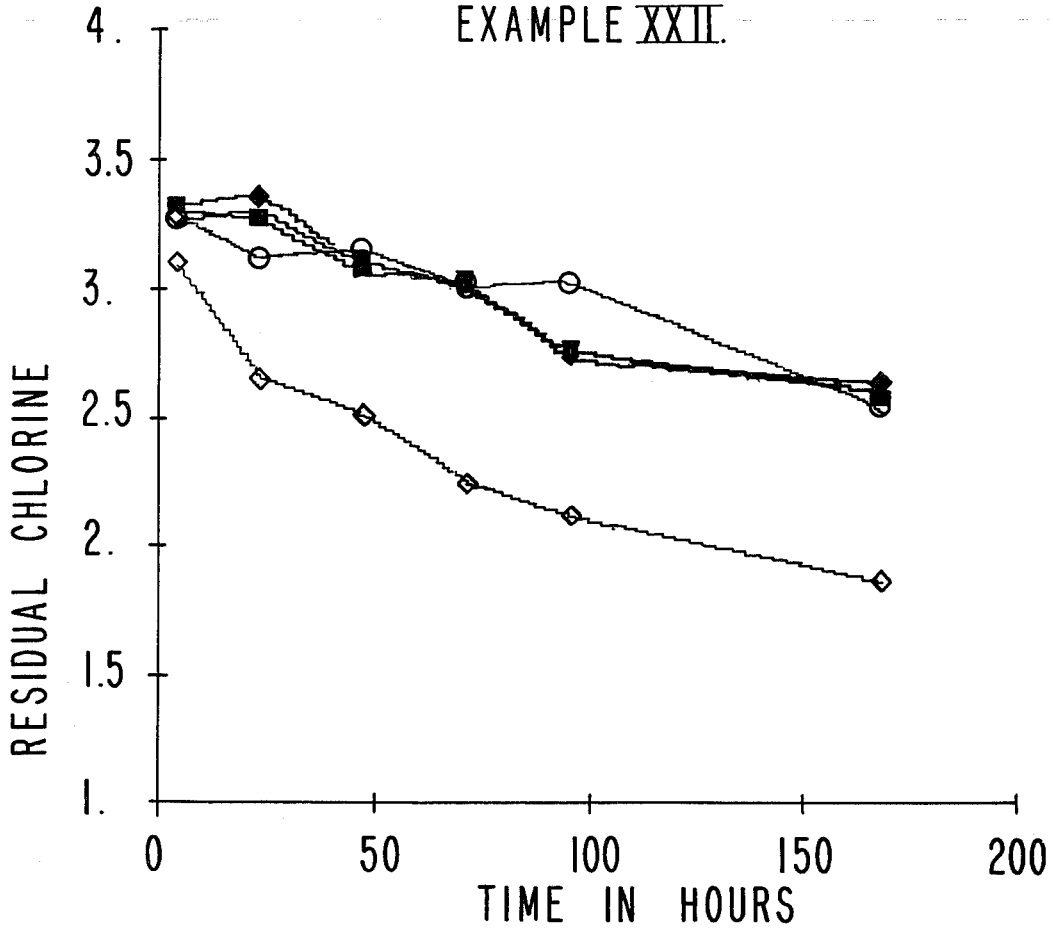

FIG. 9B is a graph of percent residual chlorine versus time in hours comparing the performance of hypochlorite solutions of (i) DOWFAX® 2Al versus (ii) AROMOX® DMMC-W using one of the diisoamylene epoxide products produced according to Example II, infra, or not using any fragrance or essential oils, with the weight ratio of AROMOX® DMMC-W:diisoamylene epoxide-base being 3.8:0.2:9 and the weight ratio of DOWFAX® 2Al:diisoamylene epoxide: base being 3.8:0.2:9 as described in Example XXII, infra.

THE INVENTION

It has now been determined that epoxides of dimers of isoamylene produced according to the reaction:

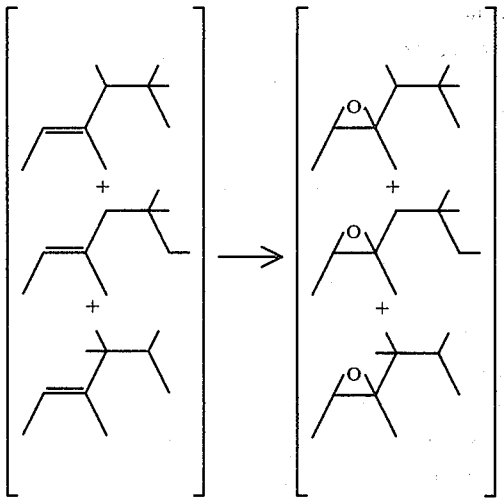

are capable of imparting or augmenting or enhancing a variety of fragrances in and to articles previously subjected to the bleaching action of aqueous hypochlorite bleach solutions by combining said epoxides of dimers of isoamylene with the hypochlorite bleach solutions prior to treating the articles and also combining with the epoxides of the dimers of isoamylene and the hypochlorite bleach mixture, at least one compound defined according to the structure:

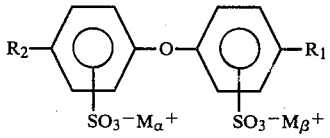

wherein at least one of $R_1$ and $R_2$ is $C_{10}$–$C_{12}$ branched or straight chain alkyl and when one of $R_1$ or $R_2$ is $C_{10}$–$C_{12}$ branched or straight chain alkyl the other of $R_1$ or $R_2$ is hydrogen and wherein $M_\alpha$ and $M_\beta$ are the same or different and each represents alkali metal, e.g. lithium, sodium or potassium.

Briefly, our invention contemplates augmenting or enhancing fragrances of articles which have been previously subjected to the action of aqueous hypochlorite bleaches by first admixing a potassium, sodium or lithium hypochlorite bleach solution (with which the said articles are to be ultimately treated) with a small but effective amount of at least one of the compounds defined according to the generic structure:

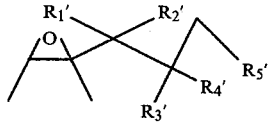

wherein $R_1'$, $R_2'$ $R_3'$, $R_4'$ and $R_5'$ are the same or different and each represents hydrogen or methyl with the proviso that (i) the sum total of the carbon atoms in $R_1'$, $R_2'$, $R_3'$, $R_4'$ and $R_5'$ is 3, and (ii) $R_1'$ and $R_2'$ represent hydrogen when $R_5'$ represents methyl and (iii) when either $R_1'$ or $R_2'$ is methyl, $R_5'$ is hydrogen.

More specifically, the structures of the compounds useful in practicing our invention are as follows:

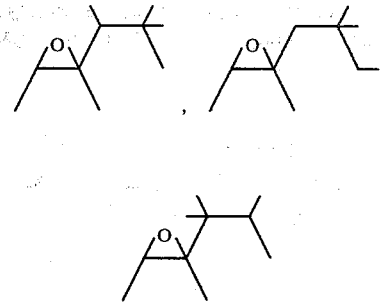

and

The diisoamylene epoxides compounds of our invention augment or enhance woody, eucalyptol-like and minty aroma characteristics of articles previously treated with hypochlorite bleaches and also "cover" the aesthetically displeasing "hypochlorite-induced" aroma which is known to accompany such treated articles. Thus, a hypochlorite bleach in accordance with our invention, is admixed with an effective amount of diisoamylene epoxide derivative and, in addition, a stabilizing and emulsifying quantity of at least one compound defined according to the structure:

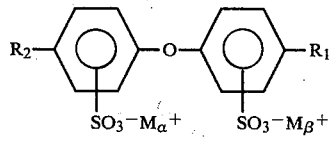

wherein at least one of $R_1$ or $R_2$ is $C_{10}$–$C_{12}$ branched or straight chain alkyl and when one of $R_1$ or $R_2$ is $C_{10}$–$C_{12}$ straight chain or branched chain alkyl the other of $R_1$ or $R_2$ is hydrogen and wherein $M_\alpha$ and $M_\beta$ are the same or different and each represent lithium, sodium or potassium.

The diisoamylene epoxide derivatives of our invention having the structures:

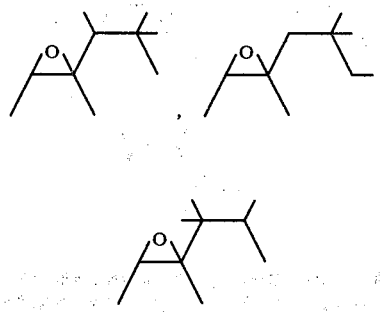

and may be prepared by first reacting 2-methyl-2-butene in the presence of an acidic catalyst which may be a Lewis acid such as, zinc chloride, aluminum chloride, aluminum bromide, diethyl aluminum chloride, diethyl aluminum bromide, ethyl aluminum dichloride, and diethyl aluminum bromide, boron trifluoride, boron trifluoride etherate, or any of the other catalysts enumerated in the following references:

i—Murphy & Lane, Ind. Eng. Chem., Prod. Res. Dev., Vol. 14, No. 3, 1975 p. 167 (Title: Oligomerization of 2-Methyl-2-Butene is Sulfuric and Sulfuric-Phosphoric Acid Mixtures).

ii—Whitmore & Mosher, Vol. 68, J. Am Chem. Soc., February, 1946, p. 281 (Title: The depolymerization of 3,4,5,5-Tetramethyl-2-hexene and 3,5,5-Trimethyl-2-heptene in Relation to the Dimerization of Isoamylenes).

iii—Whitmore & Stahly, Vol. 67, J. Am. Chem. Soc., December, 1945, p. 2158 (Title: The Polymerization of Olefins. VIII The Depolymerization of Olefins in Relation to Intramolecular Rearrangements. II).

iv—U.S. Pat. No. 3,627,700, issued on Dec. 14, 1971, (Zuech)

v—U.S. Pat. No. 3,638,181, issued on Nov. 3, 1970, (Banks)

vi—U.S. Pat. No. 3,461,184, issued on Aug. 12, 1969 (Hay, et al)

vii—Gurwitsch, Chemische Berichte, 1912, Vol. 2 p. 796 (Production of Di-isoamylene From Isoamylene Using Mercury Acetate Catalyst).

thereby forming the compounds having the structures:

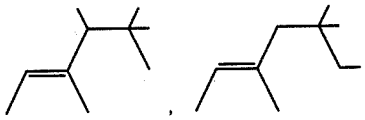

and

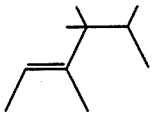

which are defined by the generic structure:

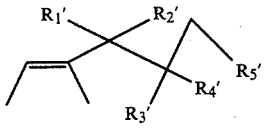

wherein $R_1'$, $R_2'$, $R_3'$, $R_4'$ and $R_5'$ are the same or different and each represents hydrogen or methyl with the proviso that (i) the sum total of carbon atoms in $R_1'$, $R_2'$, $R_3'$ $R_4'$ and $R_5'$ 3, and (ii) $R_1'$ and $R_2'$ represent hydrogen when $R_5'$ represents methyl, and (iii) when either $R_1'$ or $R_2'$ is methyl, $R_5'$ is hydrogen.

One or more of the compounds having the structures:

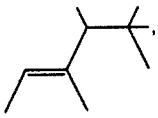

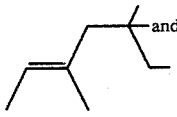

and/or

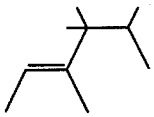

is then epoxidized using a suitable epoxidizing agent according to the conditions as set forth in either of U.S. Pat. No. 3,896,180 issued on July 22, 1975 or U.S. Pat. No. 3,723,478 issued on Mar. 27, 1973.

In so far as the first reaction is concerned, forming the compounds having the structures:

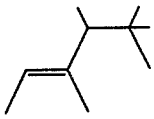

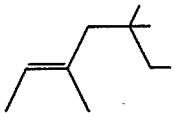

and

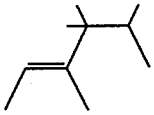

depending upon the conditions of reaction, including temperature, pressure, mole ratio of 2-methyl-2-butene:-catalyst, concentration of 2-methyl-2-butene in solvent, concentration of catalyst in solvent and time of reaction, the ratio and nature of the isomers having the structures:

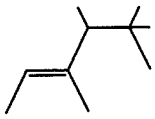

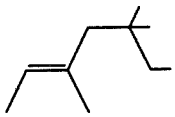

and

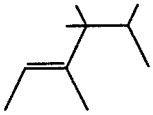

will vary in an as yet undetermined fashion. In any event, this invention contemplates the use as precursors of all isomers of di-isoamylene defined according to the structures:

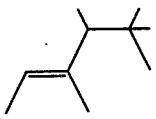

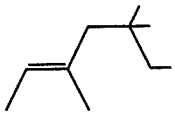

and

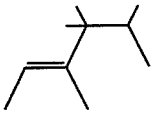

or the generic structure:

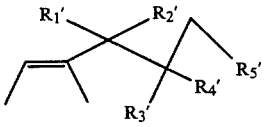

wherein $R_1'$, $R_2'$, $R_3'$, $R_4'$ and $R_5'$ are the same or different and each represents hydrogen or methyl with the proviso that (i) the sum total of carbon atoms in $R_1'$, $R_2'$, $R_3'$, $R_4'$ and $R_5'$ is three, and (ii) $R_1'$ and $R_2'$ represent hydrogen and $R_5$ represents methyl, and (iii) when either $R_1'$ or $R_2'$ is methyl, $R_5'$ is hydrogen.

Insofar as the second reaction to form the compounds having the structures:

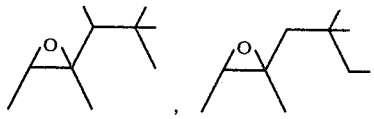

and

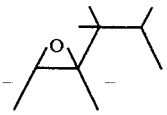

depending upon the conditions of reaction, including temperature pressure, mole ratio of compounds having the structures:

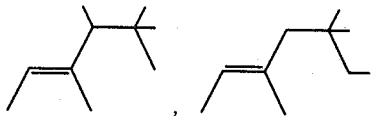

and

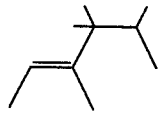

to catalyst, concentration of compounds having the structures:

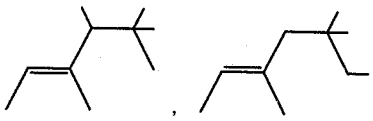

and

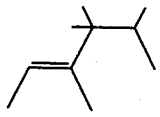

in solvent, concentration of catalyst, e.g. peracetic acid, perbenzoic acid or perphthalic acid in solvent and time of reaction, the ratio and nature of isomers having the structures:

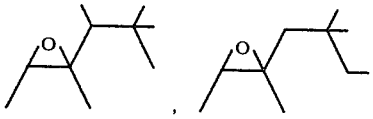

and

-continued

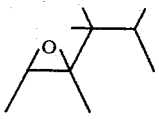

will vary in an as yet undetermined fashion. In any event, this invention contemplates the use of all isomers of the di-isoamylene epoxide defined according to the generic structure:

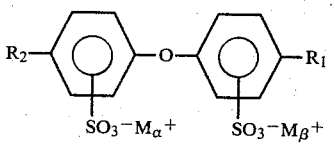

wherein $R_1'$, $R_2'$, $R_3'$, $R_4'$ and $R_5'$ are the same or different and each represents hydrogen or methyl with the proviso that (i) the sum total of carbon atoms in $R_1'$, $R_2'$, $R_3'$, $R_4'$ and $R_5'$ is 3, and (ii) $R_1'$ and $R_2'$ represent hydrogen and $R_5'$ represents methyl, and (iii) when either of $R_1'$ or $R_2'$ is methyl, $R_5'$ is hydrogen, taken alone or in admixture in all proportions, when used in augmenting or enhancing the aroma of articles previously subjected to the bleaching action of hypochlorite bleaches such as aqueous solutions of lithium, sodium or potassium hypochlorite taken alone or in admixture.

As olfactory agents, the diisoamylene epoxide derivatives of our invention, taken alone or in admixture can be formulated into, or used as components of a "perfume composition" in conjunction with the hypochlorite bleaches and $C_{10}$–$C_{12}$ dialkyl diphenylether disulfonates.

The term "perfume composition" is used herein to mean a mixture of organic compounds including, for example, alcohols, aldehydes, ketones, nitriles, ethers, lactones, natural essential oils, synthetic essential oils, hydrocarbons and epoxides other than the diisoamylene epoxide derivatives of our invention which are admixed so that the combined odors of the individual components produce a pleasant or desired fragrance but which, in combination, are compatible with (a) hypochlorite bleach solutions and (b) the diphenyloxide derivatives defined herein which are stabilizing/emulsifying agents, from a chemical and phase stability standpoint and from an organoleptic standpoint. Such perfume compositions usually contain (a) the main note or the "bouquet" or foundation stone of the composition; (b) modifiers which round off and accompany the main note; (c) fixatives which include odorous substances which lend a particular note to the perfume throughout all stages of evaporation, and substances which retard evaporation; and (d) top notes which are usually low boiling, fresh-smelling materials.

In perfume compositions, the individual component will contribute its particular olfactory characteristics, but the overall effect of the perfume composition will be (a) the sum of the effects of each of the ingredients and (b) in certain instances, a synergistic effect as a result of the addition of certain ingredients. Thus, the individual compounds of this invention, or mixtures thereof, can be used to alter the aroma characteristics of a perfume composition, for example, by highlighting or moderating the olfactory reaction contributed by another ingredient in the composition.

The amount of the diisoamylene epoxide derivatives of this invention which will be effective in perfume compositions depends on many factors, including the other ingredients, their amounts and the effects which are desired. It has been found that perfume compositions containing as little as 0.05% of the diisoamylene epoxide derivatives of this invention, or even less, can be used to impart an interesting, woody, eucalyptol-like, minty aroma to articles previously treated with hypochlorite bleach compositions. The amount employed can range up to 70% or even higher, and will depend on considerations of cost, nature of the end product and the effect desired on the finished product and particular fragrance sought. Thus, for example, when fragrancing liquid bleach compositions containing alkali metal hypochlorite such as, for example sodium hypochlorite, for example CLOROX® (registered trademark of CLOROX, Inc.), the amount employed can be as high as 100% of the fragrance used in the liquid bleach.

In addition, the perfume composition can contain a vehicle or carrier for the diisoamylene epoxide derivatives, alone, or with other ingredients. The vehicle can be a liquid such as a non-toxic alcohol such as ethanol, a glycol such as propylene glycol, or the like. The carrier can be an absorbent solid, such as a gum or components for encapsulating the composition such as gelatin which can be used to form a capsule wall surrounding the perfume (produced by e.g. coacervation) when this solid is suspended in the hypochlorite bleach composition.

Thus, this invention relates to the production of also of perfumed single phase aqueous alkali metal hypochlorite solutions suitable for laundry and general domestic bleaching and sterilizing purposes. We have found that it is now possible to provide perfumed aqueous alkali metal hypochlorite solutions which yield a long lasting perfume aroma in the minty, eucalyptol-like and woody area, and which are capable of imparting to surfaces (e.g. laundry and the hands of the user which are in direct contact with the hypochlorite solutions) to which they are applied a pleasant "woody", "eucalyptol-like" and "minty" aroma and at the same time substantially diminishing or eliminating altogether the characteristic disagreeable "hypochlorite" aroma therefrom.

Accordingly, this invention consists of an aqueous solution of at least one alkali metal hypochlorite containing a stable perfume oil having as its main ingredient at least one of aforementioned diisoamylene epoxide derivatives and a surface active agent either consisting (i) solely of a $C_{10}$–$C_{12}$ alkyl diphenyl oxide dialkali metal sulfonate having the structure:

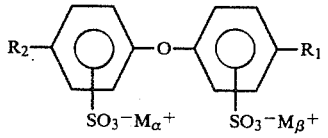

wherein at least of $R_1$ or $R_2$ is straight chain or branched chain $C_{10}$–$C_{12}$ alkyl and when one of $R_1$ or $R_2$ is straight chain or branched chain $C_{10}$–$C_{12}$ alkyl the other of $R_1$ or $R_2$ is hydrogen and wherein $M_\alpha$ and $M_\beta$ are the same or different and each is an alkali metal such as sodium, potassium or lithium; for example the compounds defined according to the structure:

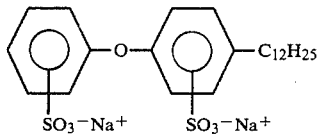

(wherein $C_{12}H_{25}$ represents several $C_{12}$ branched chain moieties) or the compounds defined according to the structure:

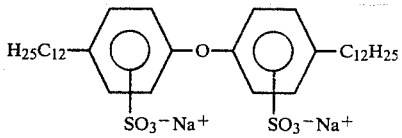

(wherein $C_{12}H_{25}$ represents several $C_{12}$ branched chain moieties) or the compounds defined according to the structure:

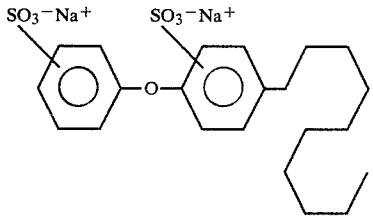

or the compounds defined according to the structure:

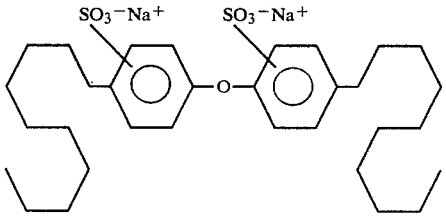

or mixtures of one or more of the foregoing compounds, or (ii) a mixture of at least one compound defined according to the generic structure:

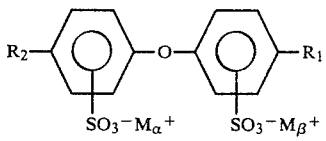

(wherein $R_1$, $R_2$, $M_\alpha$ and $M_\beta$ are defined supra) and an amine oxide composition consisting essentially of one or more morpholine and/or dimethyl $C_{11}$–$C_{13}$ straight chain alkyl amine oxide having the generic structure:

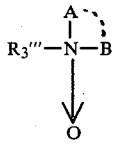

in an amount greater than 55% of said amine oxide composition wherein $R_3'''$ is straight chain alkyl having from 11 up to 13 carbon atoms and A and B are each separately methyl, or taken together, complete a morpholino ring and having a pH in the range of 11–14.0.

The chain lengths of the $R_3'''$ moiety (or moieties) of the predominating alkyl dimethyl amine oxides of the amine oxide composition aids in providing for an aqueous hypochlorite bleach or sterilizing solution which can be perfumed in the "woody" "eucalyptol-like" and "minty" aroma formulations required for our invention, but the compound having the structure:

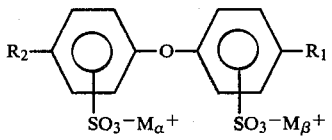

or mixture of such compounds taken alone or taken further together with the alkyl dimethyl amine oxide composition will aid even further in providing such a perfume hypochlorite bleach formulation and the compounds defined according to the structure:

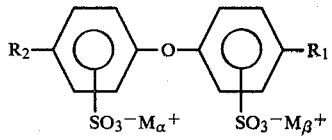

as stated above may be used alone.

The concentration of the composition of matter consisting essentially of the compounds having the structure:

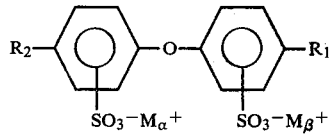

(wherein $R_1$, $R_2$, $M_\alpha$ and $M_\beta$ are defined supra) taken alone or taken in admixture with the amine oxide composition required to create the transparent liquid phase or gel phase solution of this invention is from 0.10% up to 2.0% based on the total weight of solution. Concentrations of diphenyl oxide derivatives less than 0.10% or mixtures of diphenyl oxide derivatives and amine oxides of less than 0.10% will not give rise to the desired single liquid or gel phase system containing the desired special perfume oil consisting essentially of one or more diisoamylene epoxide isomers having the eucalyptol, minty and woody aroma profile required for this invention. From a commercial standpoint the concentration of $C_{10}$–$C_{12}$ straight chain or branched chain alkyl substituted diphenyl oxide dialkali metal sulfonate (hereinafter referred to as "diphenyl oxide derivative") taken alone or taken in conjunction with amine oxide greater than 2.0% based on the total weight of hypochlorite solution are not needed and give rise to unnecessary costs.

The pH range of the aqueous alkali metal hypochlorite solution containing the $C_{10}$–$C_{12}$ straight chain or branched chain substituted diphenyl oxide dialkali metal sulfonate composition having the structure:

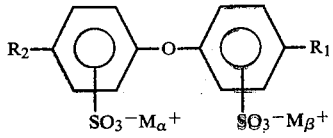

taken alone or in conjunction with the amine oxide composition having the structure:

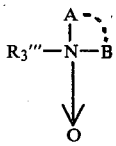

and one of the requisite perfume formulation consisting essentially of one or more of the diisoamylene epoxide derivatives of our invention which are stable to aqueous hypochlorite and which are capable of yielding and imparting the desired and required overall eucalyptol-like, minty and woody fragrance impression is critical; that is, a pH of from 11 up to 14.0 is required for the composition of our invention, with a preferred pH range being between 12.0 and 13.1. The requisite pH range is achieved by adding an aqueous solution of alkali metal hydroxide (e.g. from 1 molar up to 12.5 molar) to the alkali metal hypochlorite solution which has had or will have added to it the $C_{10}$–$C_{12}$ straight or branched chain alkyl substituted diphenyl oxide dialkali metal sulfonate-diisoamylene epoxide perfume oil premix or the $C_{10}$–$C_{12}$ straight or branched chain alkyl substituted diphenyl oxide dialkali metal sulfonate-amine oxide-diisoamylene epoxide-containing perfume oil premix.

The percentage of diisoamylene epoxide-containing perfume oil or diisoamylene epoxide per se having the properties which yield eucalyptol-like minty or woody aromas is in the range of from 0.01% up to 0.8% based on the total final weight of alkali metal hypochlorite solution. Lower concentrations of such perfume oils will not be adequate to give rise to the desired substantial diminution or elimination of the characteristic disagreeable hypochlorite aroma (which exists on, for example, laundry and/or the hands of the individual user which have been in direct contact with the hypochlorite bleach or sterilizing solution subsequent to the use of aqueous hypochlorite solutions as a general domestic bleach or sterilizer). Quantities of perfume oil greater than 0.8% have been found to be uneconomical and unnecessary for the practice of our invention, although, in the case of using the diisoamylene epoxide derivatives of our invention as aromatizing agents (without any additional adjuvants) or in the case of using the diisoamylene epoxide derivatives of our invention together with (i) diisoamylenes of application for U.S. Pat. Ser. No. 188,576 filed on Oct. 9, 1980 or (ii)

acyl diisoamylene derivatives described in application for U.S. Ser. No. 184,132 filed on Sept. 4, 1980 and/or ketal derivatives thereof as described in application for U.S. Pat. Ser. No. 212,993 filed on Dec. 4, 1980, the very low cost of diisoamylene epoxide derivatives taken alone or further together with other diisoamylene derivatives as set forth above, and the very high stability of the diisoamylene epoxide derivatives taken alone or further together with other diisoamylene derivatives as set forth supra, give rise to a very economical use even at very high levels.

Several processes may be used in order to produce a hypochlorite bleaching or sterilizing solution whereby the desired eucalyptol-like, minty and woody aroma profiles are imparted to the articles treated with said hypochlorite solutions. Thus, for example, the diisoamylene epoxide-containing perfume oil may be premix with the diphenyl oxide derivative or diphenyl oxide derivative-amine oxide solubilizer-stabilizer (having the structures, respectively:

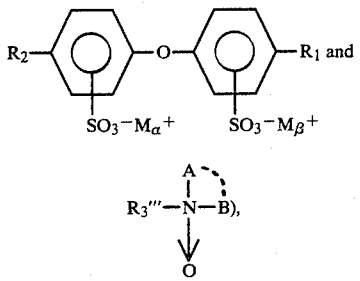

and the resulting perfume oil-diphenyl oxide derivative or perfume oil-diphenyl oxide derivative-amine oxide premix is then mixed with the hypochlorite bleaching or stirilizing solution with stirring. Immediately after such addition, an aqueous alkali metal hydroxide solution is added to the mixture to bring the pH to the range of 11–14.0. A pH of less than 11 is not desired since it is difficult to achieve a single phase stable system at such low pH's. A pH higher than 14.0 will also create a system which (1) is unnecessarily corrosive; (2) will narrow the range of perfume oils usable in conjunction with the diisoamylene epoxide derivatives in the system; and (3) will limit the particular ingredients usable in such perfume oils in conjunction with the diisoamylene epoxide derivatives. On the other hand, if the diisoamylene epoxides are used alone or solely in combination with (i) diisoamylenes as described in application for U.S. patent Ser. No. 188,576 filed on Oct. 9, 1980 or (ii) acyl diisoamylene derivatives described in application for U.S. patent Ser. No. 184,132 filed on Sept. 4, 1980 and/or ketal derivatives thereof as described in application for U.S. patent Ser. No. 212,993 filed on Dec. 4, 1980, a pH of about 14.0 and even slightly higher (e.g. 14.1) is acceptable.

The aqueous alkali metal hydroxide can be added to the aqueous alkali metal hypochlorite solution before adding the diphenyl oxide derivative (taken alone or in conjunction with the amine oxide) or the diisoamylene epoxide or the diisoamylene epoxide-containing perfume oil. Indeed, the ingredients: the diisoamylene epoxide or diisoamylene epoxide-containing perfume oil; the alkali metal hydroxide and the diphenyl oxide derivative or diphenyl oxide derivative-amine oxide composition (having the structures respectively:

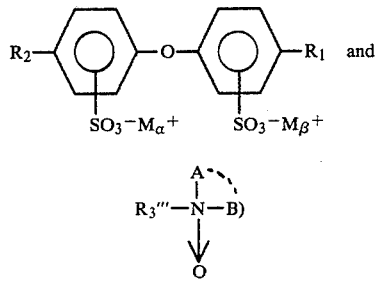

may be added or admixed in any order which is convenient to the formulator. One desirable process involves first forming the diphenyl oxide derivative or diphenyl oxide derivative-amine oxide composition-diisoamylene epoxide or diisoamylene epoxide-containing perfume oil "premix", mixing the premix with the alkali metal hypochlorite solution and finally adjusting the pH of the solution with alkali metal hydroxide to bring the pH to within the range of 11–14.0. A second, more preferable process, involves first adjusting the pH of the aqueous alkali metal hypochlorite solution to 11–14.0 and then admixing the solution with the afore-described "premix".

The alkali metal hypochlorites preferred in the practice of our invention are: sodium hypochlorite, potassium hypochlorite and lithium hypochlorite or mixtures of same. The alkali metal hydrooxides preferred in the practice of this invention are: lithium hydroxide, potassium hydroxide and sodium hydroxide or, if desired, mixtures of such hydroxides.

The temperature at which the composition of our invention remains both substantially stable and commercially useful for the purposes set forth herein (that is, remains as a clear single aqueous or gel phase and retains (1) the desired properties inherent in the known bleaching and sterilizing uses of aqueous alkali metal hypochlorite liquid or gel solutions, and (2) the properties imparted thereto as a result of the diisoamylene epoxide derivatives or diisoamylene epoxide-containing perfume oils which impart to articles previously subjected to the aqueous alkali metal hypochlorite gel or liquid solutions a eucalyptol-like, minty and woody aroma profile, varies from approximately 20° F. up to approximately 120° F. At temperatures below 20° F. a two-phase system usually occurs and at temperatures higher than 120° F. the bleaching or sterilizing efficiency of the compositions of our invention is diminished at an excessive rate.

When it is desired to (1) initially form the $C_{10}$–$C_{12}$ straight chain or branched chain diphenyl oxide alkali metal sulfonate or diphenyl oxide derivative-amine oxide-diisoamylene epoxide or diisoamylene epoxide-containing perfume oil premix; (2) then combine the resulting premix with an aqueous alkali metal hypochlorite solution and then (3) adjust the pH of the resulting solution to the range of 11–14.0 then the temperature of mixing ranges are considered to be within the scope of this invention:

(a) Formation of the diphenyl oxide derivative or diphenyl oxide-amine oxide-diisoamylene epoxide or diisoamylene epoxide-containing perfume oil premix: 20° F.–150° F.

(b) Mixing the premix with aqueous metal alkali hypochlorite solution: 20° F.–120° F.

(c) Adjustment of pH of solution to the range of 11–14.0 using aqueous alkali metal hydroxide solution: 20° F.–120° F.

In any event, wherever a mixing unit operation involves the aqueous alkali metal hypochlorite solution, the temperature of mixing is limited to the range of 20° F.–120° F. Where the mixing unit operation involves the mixing of a diisoamylene epoxide or diisoamylene epoxide-containing perfume oil, the upper bound of the temperature range is limited by the stability of the least stable ingredient in the diisoamylene epoxide composition of matter of diisoamylene epoxide-containing perfume oil usable in the practice of our invention; and the lower bound of said temperature range is limited by the least temperature where a single liquid phase or gel phase including the perfume oil will exist. Where a unit mixing operation of the process of our invention involves the mixing of one or more diphenyl oxide derivatives having the generic structure:

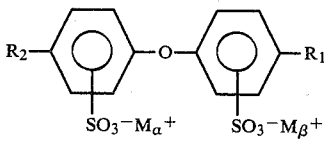

taken alone or taken together with one or more amine oxides having the generic structure:

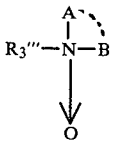

with other materials, the upper bound of the temperature range is the decomposition point of any one of the diphenyl oxide derivatives or amine oxide components and the lower bound is the least temperature where a single liquid phase or gel phase, including the diphenyl oxide derivatives or diphenyl oxide-amine oxide mixture will exist.

Preferred diphenyl oxide derivative compositions from a practical standpoint useful in the practice of our invention are compounds having the structure:

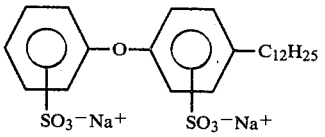

where the $C_{12}H_{25}$ moiety represents one or a series of different branched chains; compounds defined according to the structure:

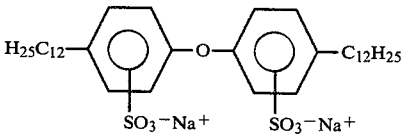

where the $C_{12}H_{25}$ moiety represents one or a series of different branched chains; compounds defined according to the structure:

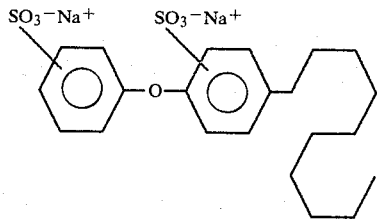

and compounds defined according to the structure:

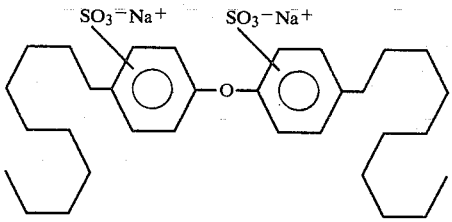

otherwise known as DOWFAX® 2A1 in the case where one of $R_1$ or $R_2$ represents branched $C_{12}H_{25}$ alkyl chains and the other of $R_1$ or $R_2$ represents hydrogen, or DOWFAX® 3B2 in the case where one of $R_1$ or $R_2$ represents straight $C_{10}$ alkyl chain and the other of $R_1$ or $R_2$ represents hydrogen (DOWFAX® being a registered trademark of the Dow Chemical Company of Midland, Mich.).

When used in conjunction with the diphenyl oxide derivatives, preferred amine oxide compositions, from a practical standpoint, useful in the practice of our invention are the commercially available (1) dimethyl "cocoamine" oxide (a mixture which is dominated by dimethyl-$C_{12}$–$C_{16}$ straight chain alkyl amine oxides; more particularly a mixture containing approximately 70% $C_{12}$ straight chain alkyl amine oxides, approximately 25% of straight chain $C_{14}$ alkyl amine oxides and approximately 4% straight chain $C_{16}$ alkyl amine oxides) and (2) N-cocomorpholine oxide, a mixture dominated by straight chain $C_{12}$–$C_{16}$ alkyl morpholine oxides (specifically containing approximately 70% straight chain $C_{12}$ alkyl morpholine oxide, approximately 25% straight chain $C_{14}$ alkyl morpholine oxide, and approximately 4% straight chain $C_{16}$ alkyl morpholine oxide). Commercial examples of such amine oxide compositions are: Aromox® DMC-W and Aromox® DMMC-W which are 30% aqueous dimethyl cocoamine oxide solutions and Aromox® NCMDW which is a 40% aqueous N-cocomorpholine oxide solution, each of which is produced by the Armac Division of AKZO of Chicago, Illinois. These materials are described in Brochure 68011, published by Armour Industrial Chemicals, P.O.B. 1805, Chicago, Ill. 60690. Other preferred amine oxides are n-undecyl dimethyl amine oxide and n-tridecyl dimethyl amine oxide.

The percentage of hypochlorite ion in the compositions of our invention may vary from about 1% up to about 20% for the desired effects to be produced using the diphenyl oxide derivative or diphenyl oxide derivative-amine oxide-diisoamylene epoxide or diisoamylene epoxide-containing perfume oil compositions covered by our invention. The usual percent of alkali metal hypochlorite in solution is about 5%, the percentage of sodium hypochlorite in such materials as CLOROX ® the registered trademark of Clorox Corporation.

As stated above, the diisoamylene epoxide or diisoamylene epoxide-containing perfume oil used in conjunction with the aqueous alkali metal hypochlorite solution must have such properties as to be able (1) to impart to the resulting or "aqueous alkali metal hypochlorite" liquid or gel solution either a "eucalyptol-like" or "minty" or "woody" aroma or combination thereof; (2) to effect a substantial diminution or elimination of the disagreeable "hypochlorite" aroma which is imparted to surfaces (e.g. bleached laundry or the hands of the user which are in direct contact with the hypochlorite solution) on which known aqueous alkali metal hypochlorite solutions have been used; and (3) to impart to the surfaces with which such aqueous alkali metal hypochlorite solutions are in contact, a pleasant long lasting stable eucalyptol-like, minty and/or woody aroma. Examples of ingredients usable and suitable for the aforementioned purposes, that is usable in conjunction with the diisoamylen epoxides and usable in conjunction with the hypochlorites and diphenyl oxide derivatives of our invention are as follows:

1. Cedryl alkyl ethers covered by U.S. Pat. No. 3,373,208 such as cedryl methyl ether;
2. Isochroman musks covered by U.S. Pat. No. 3,360,530 and 3,591,528 such as 6-oxa-1,1,3,3,8-pentamethyl-2,3,5,6,7,8-hexahydro-1H-benz(f)indene;
3. Polycyclic ethers covered by U.S. Pat. No. 3,281,432, such as octahydro-1,3a,6-trimethyl-1H-1,6a,ethanopentaleno-(1,2-C)furan;
4. Polycyclic ketones such as hexahydro-1,1,5,5-tetramethyl-2H-2,4a-methanonaphthalen-8-(5H)one.
5. Diisoamylenes described according to application for U.S. patent Ser. No. 188,576 filed on Sept. 18, 1980;
6. Acyl diisoamylene derivatives described according to application for U.S. patent Ser. No. 184,132 filed on Sept. 4, 1980 and ketal derivatives thereof described according to application for U.S. patent Ser. No. 212,993 filed on Dec. 4, 1980.

It will be understood that a number of materials which impart or augment or enhance eucalyptol-like, minty and woody aromas will not be useful for use in our invention because they are, interalia, easily oxidized by the alkali metal hypochlorite in the system. Examples are 1,5,9-trimethyl-12-acetyl-cyclododecatriene-1,5,8 and 1,5,9-trimethyl-12-cyclodecadiene-1,8 covered by British Pat. No. 1,204,409.

A basic feature of our invention concerns the fact that the only detergent group needed or desirable in the composition of our invention is the class of diphenyl oxide derivatives defined according to the structure:

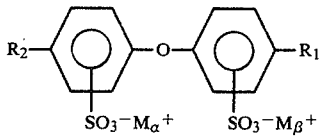

wherein $R_1$, $R_2$, $M_\alpha$ and $M_\beta$ are defined supra, taken alone or in conjunction with the class of morpholino and/or dimethyl $C_{11}$–$C_{13}$ straight chain alkyl amine oxides defined according to the structure:

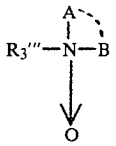

More specifically, such detergents as sodium decyl ether sulfate, sodium myristyl ether sulfate, sodium lauryl ether sulfate and lithium lauryl ether sulfate are neither desired nor are they required. Furthermore the well known hydrotropes employed in prior art compositions such as the well known family of clarifying agents comprising the alkali metal or alkali earth metal salts of mono- and polyalkylated benzene or naphthalene sulfonates such as sodium xylene or magnasium toluene sulfonate are again neither desired nor are they required in the compositions intended to be encompassed by the instant invention.

Another basic feature of our invention concerns the fact that when it is desired to have a gel phase composition, thickener agents may be employed in conjunction with the system: hypochlorite bleach-diisoamylene epoxide or diisoamylene epoxide-containing perfume-diphenyl oxide derivative or diphenyl oxide-derivative-amine oxide (having the generic structure:

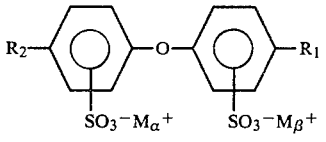

and having the structure:

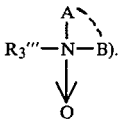

of our invention.

Still another basic feature of our invention concerns the fact that gel phase compositions including thickener agents may be employed with the "premix" system: diisoamylene epoxide or diisoamylene epoxide-containing perfume-diphenyl oxide derivative or diphenyl oxide derivative-amine oxide of our invention.

Thus, sodium palmitate, sodium stearate, sodium laurate, potassium palmitate, potassium stearate, potassium laurate, lithium palmitate, lithium stearate and/or lithium laurate or combinations of the foregoing may be added to the compositions of matter of our invention to provide a thickened gel-type hypochlorite bleach which is in addition to being in a semi-solid state unobviously, advantageously and unexpectedly stable over long periods of time. Percentages of thickening agents such as sodium palmitate, sodium stearate, sodium laurate, potassium palmitate, potassium stearate, potassium laurate, lithium palmitate, lithium stearate or lithium laurate or combinations of these which may be used in the thickened compositions of our invention are from 1% by weight up to 12% by weight of the thickener based on overall weight of hypochlorite bleach-diphenyl oxide derivative or diphenyl oxide derivative-amine oxide-diisoamylene epoxide or diisoamylene epoxide-containing perfume perfume composition of our invention. When it is merely desired to have a thickened "premix" the percentage of thickening agent may vary from about 5% up to about 40% by weight of thickener based on overall weight of "premix".

The following examples are given to illustrate embodiments of the invention as it is now preferred to practice it. It will be understood that these examples are illustrative and the invention is not to be considered as restricted thereto except as indicated in the appended claims.

EXAMPLE I

PREPARATION OF DI-ISOAMYLENE DERIVATIVES

Reaction:

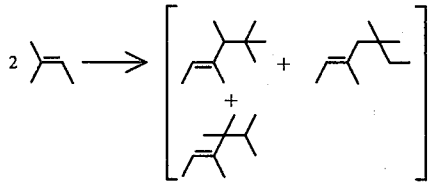

Di-isoamylene is prepared according to one of the procedures set forth in the following references:

i—Murphy & Lane, Ind. Eng. Chem., Prod. Res. Dev., Vol. 14, No. 3, 1975 p. 167 (Title: Oligomerization of 2-Methyl-2-Butene in Sulfuric and Sulfuric-Phosphoric Acid Mixtures).

ii—Whitmore & Mosher, Vol. 68, J. Am. Chem. Soc., Feb., 1946, p. 281 (Title: The Depolymerization of 3,4,5,5-Tetramethyl-2-hexene and 3,5,5-Trimethyl-2-heptene in Relation to the Dimerization of Isoamylenes)

iii—Whitmore & Stahly, Vol. 67, J. Am. Chem. Soc., Dec., 1945, p. 2158 (Title: The Polymerization of Olefins. VIII The Depolymerization of Olefins in Relation to Intramolecular Rearrangements. II)

iv—U.S. Pat. No. 3,627,700, issued on Dec. 14, 1971, (Zuech)

v—U.S. Pat. No. 3,538,181, issued on Nov. 3, 1970, (Banks)

vi—U.S. Pat. No. 3,461,184, issued on Aug. 12, 1969 (Hay, et al)

vii—Gurwitsch, Chemische Berichte, 1912, Vol. 2, p. 796 (Production of Di-isoamylene From Isoamylene Using Mercury Acetate Catalyst)

As an illustration, and not by way of limitation, the following Example sets forth the preparation of di-isoamylenes useful in producing the fragrances of our invention:

Over a period of ten hours, 2-methyl-2-butene is pumped through a 5'×⅝ (0.625 inch) tube packed with 15.0 g of polystyrene sulfonic acid catalyst, at a temperature of 100° C. and at a pressure of 400 psig.

The resulting material was distilled in a fractionation column in order to separate the di-isoamylene from the higher molecular weight polymers, which are formed during the reaction as by-products.

Figure 1A:
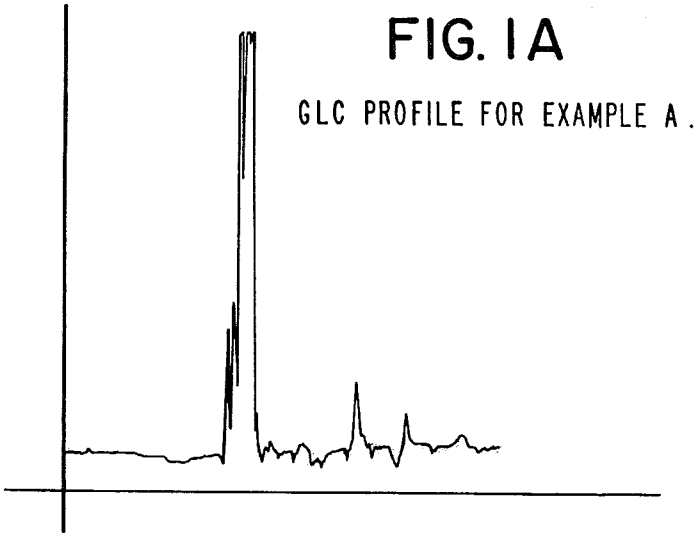
FIG. 1A represents the GLC profile for the reaction product of Example I using a 70% sulfuric acid catalyst at 35° C.

FIG. 1A represents the GLC profile for the reaction product of Example I using a 70% sulfuric acid catalyst at 35° C.

Figure 1B:
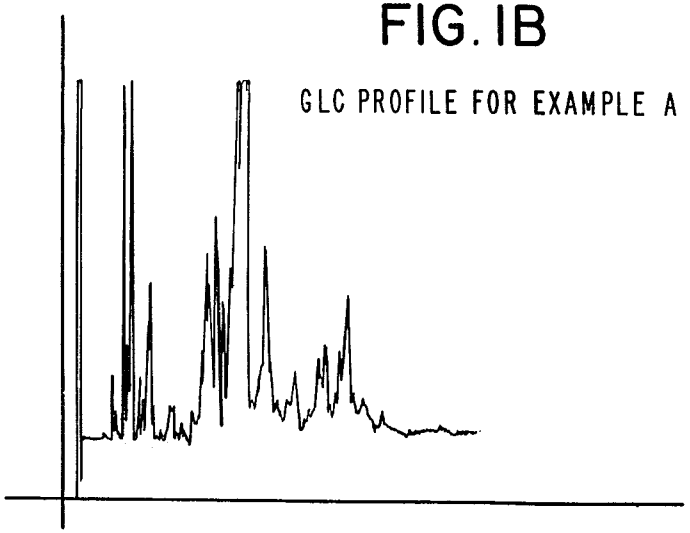
FIG. 1B represents the GLC profile for the reaction product of Example I using an Amberlyst® 15 acidic ion exchange resin catalyst at a temperature of 150° C.

FIG. 1B represents the GLC profile for the reaction product of Example I using an Amberlyst® 15 acidic ion exchange resin catalyst at a temperature of 150° C.

Figure 1C:
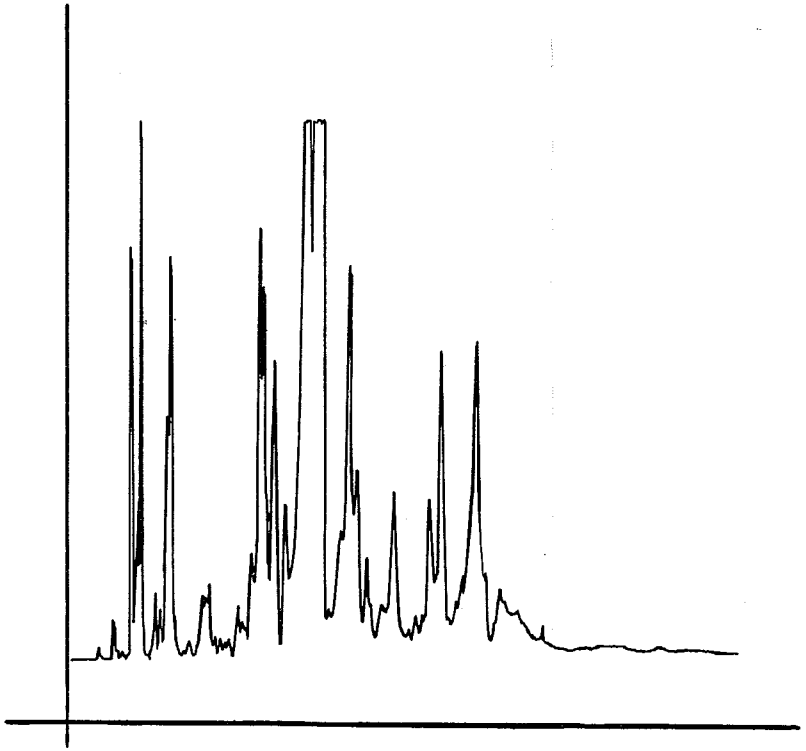
FIG. 1C represents the GLC profile for the reaction product of Example I, using an Amberlyst® 15 catalyst at 100° C.

FIG. 1C represents the GLC profile for the reaction product of Example I, using an Amberlyst® 15 catalyst at 100° C.

Figure 1E:
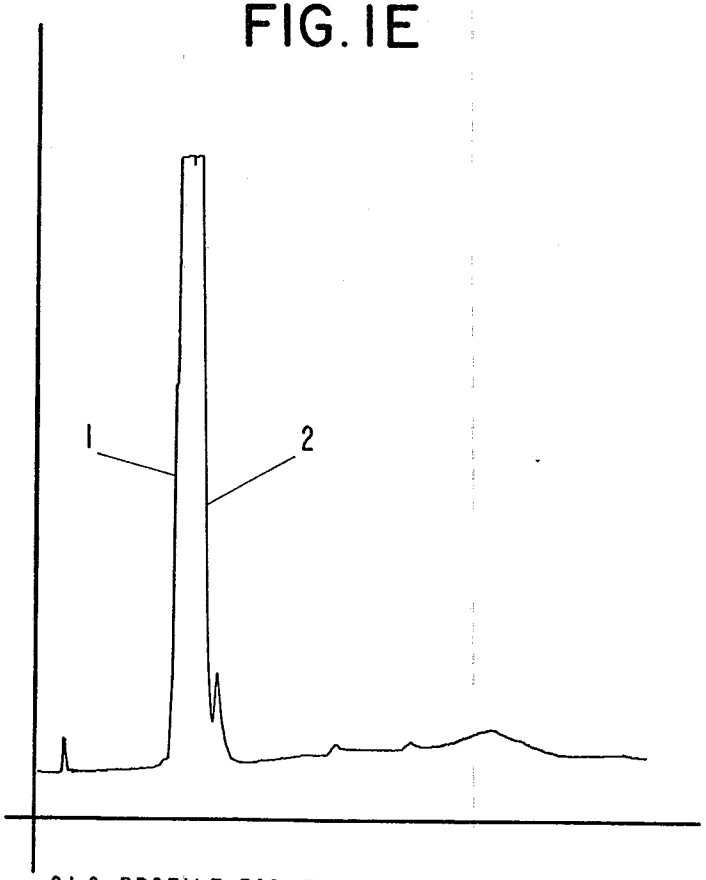
FIG. 1E represents the GLC profile for the reaction product of Example I, using a sulfuric acid catalyst, at 35° C. and an alpha-methylstyrene diluent according to the conditions of United Kingdom Patent Specification No. 796,130 (distilled reaction product).
Figure 1D:
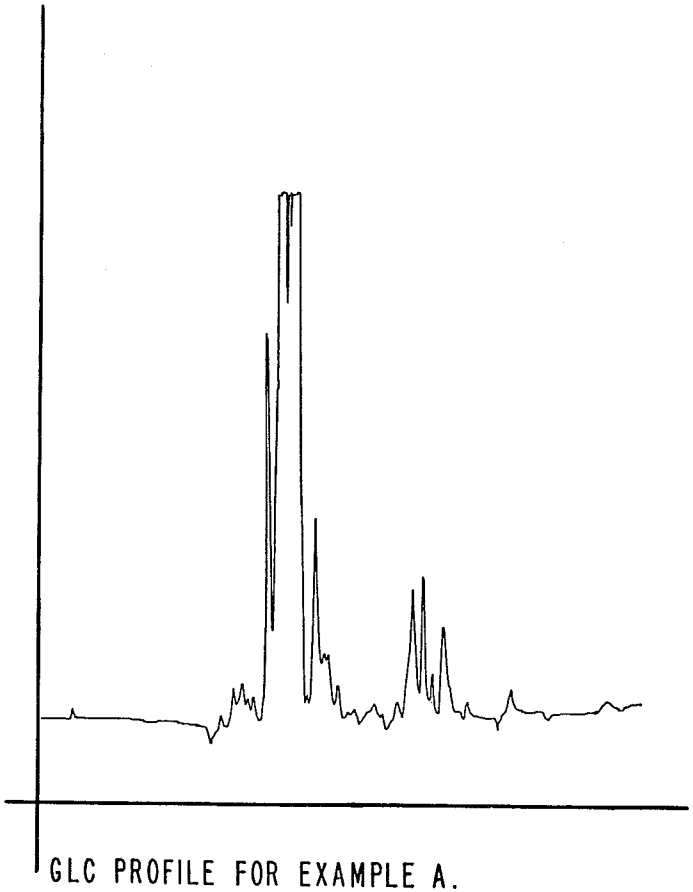
FIG. 1D represents the GLC profile for the reaction product of Example I, using a sulfuric acid catalyst and an alpha-methylstyrene diluent at 35° C. according to the conditions of United Kingdom Patent Specification No. 796,130 (crude reaction product)

FIG. 1D represents the GLC profile for the reaction product of Example I, using a sulfuric acid catalyst and an alpha-methylstyrene diluent at 35° C. according to the conditions of United Kingdom Patent Specification No. 796,130 (crude reaction product)

FIG. 1E represents the GLC profile for the reaction product of Example I, using a sulfuric acid catalyst, at 35° C. and an alpha-methylstyrene diluent according to the conditions of United Kingdom Patent Specification 796,130 (distilled reaction product).

FIG. 2A represents the NMR spectrum for Peak 1 of the GLC profile of FIG. 1E.

FIG. 2B represents the infra-red spectrum for Peak 1 of the GLC profile of FIG. 1E.

FIG. 3A represents the NMR spectrum for Peak 2 of the GLC profile of FIG. 1E.

FIG. 3B represents the infra-red spectrum for Peak 2 of the GLC profile of FIG. 1E.

FIG. 4 represents the NMR spectrum for Peak 2 of the GLC profile of FIG. 1B.

EXAMPLE II

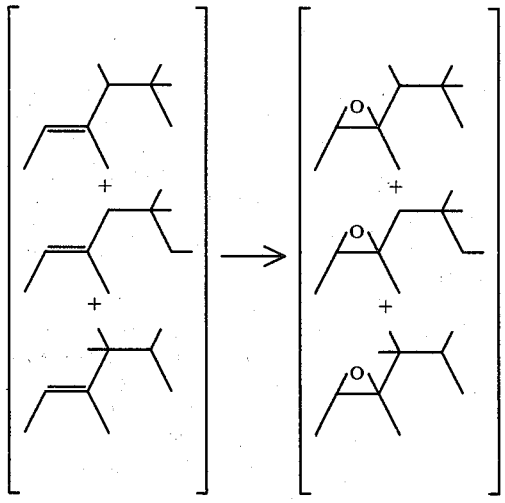

Into a 12 liter reaction flask, equipped with stirrer, reflux condenser, thermometer, addition funnel and cooling bath is placed 5,478 ml of di-isoamylene containing the compounds having the structures:

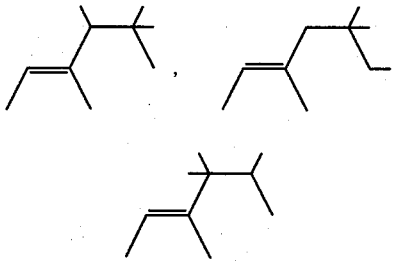

produced according to Example I. To the di-isoamylene material is added 120 grams of sodium carbonate. Over a period of 2.5 hours 5,130 grams (4,520 ml or 27 moles) of 40% peracetic acid is added to the reaction mass while maintaining the temperature at 20° C.–26° C. 200 grams additional sodium carbonate are then added to the reaction mass. The reaction mass is then cooled to room temperature and transferred to a 5 galon separatory funnel. The reaction mass is then washed as follows:

a. 1 liter water
b. Three 1.5 liter portions of 12.5% sodium hydroxide solution (to eliminate peroxides)
c. Three 1.5 liter portions of saturated sodium chloride solution The reaction mass is then distilled on an 18" Goodloe® column, yielding the following fractions:

| Fraction No. | Vapor Temp. (°C.) | Liquid Temp. (°C.) | Pressure (mmHg) | Weight of Fraction (g) |
|---|---|---|---|---|
| 1 | 79/85 | 88/88 | 40/40 | 180 |
| 2 | 85 | 88 | 40 | 153 |
| 3 | 85 | 88 | 40 | 203 |
| 4 | 83/85 | 88/88 | 40 | 210 |
| 5 | 86 | 88 | 40 | 176 |
| 6 | 86 | 88 | 40 | 196 |
| 7 | 86 | 90 | 40 | 209 |
| 8 | 85/86 | 89/91 | 40 | 192 |
| 9 | 86 | 98 | 40 | 138 |
| 10 | 86 | 160 | 40 | 73 |
| 11 | 84 | 220 | 40 | 18 |

NMR, IR and mass spectral analysis yield the information that the reaction product contains three compounds having the structures:

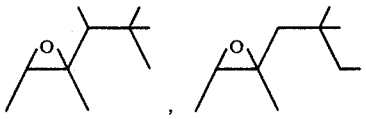

and

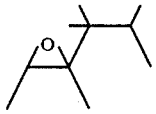

FIG. 5 is the GLC profile of the reaction product of Example II containing the compounds having the structures:

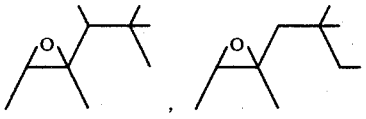

and

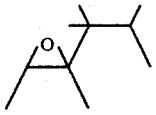

FIG. 6 is the MNR spectrum for the reaction product of Example II containing the compounds having the structures:

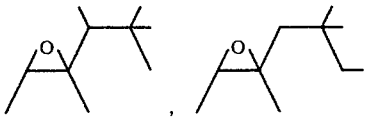

and

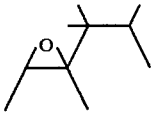

FIG. 7 is the infra-red spectrum for the reaction product of Example II containing the compounds having the structures:

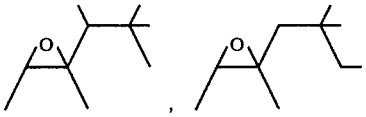

and

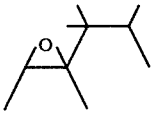

EXAMPLE III

The di-isoamylene epoxide product produced according to Example II has a woody, eucalyptol, minty note which may be utilized to a great extent in inexpensive functional products. The following pine fragrance demonstrates the use of this material in perfume compositions. In this case it is used in a concentration of 47.9%.

| | |
|---|---|
| Di-isoamylene epoxide of Example II | 479 |
| Isobornyl Acetate | 100 |
| Camphor | 10 |
| Terpineol | 25 |
| Fir Balsam Absolute (50% in Diethyl Phthalate | 20 |
| Coumarin | 4 |
| Linalool | 30 |
| Anethol | 2 |
| Fenchyl Alcohol | 10 |
| Lemon Terpenes Washed | 50 |
| Borneol | 5 |
| Galbanum Oil | 5 |
| Turpentine Russian | 150 |
| Pinus Pumilionus | 50 |
| Eucalyptol | 50 |
| 2,2,6-trimethyl-1-cyclohexene-1-carboxaldehyde | 5 |
| Maltol 1% in Diethyl Phthalate | 5 |

The presence of the di-isoamylene epoxide supports the pine notes and produces a considerable savings in the cost of the formulation. It also lends a pleasant and strong minty, herbaceous and woody character to this pine fragrance. The pine fragrance is extremely stable, particularly in hypochlorite bleaches as will be seen infra.

EXAMPLE IV

Preparation of a Cosmetic Powder Composition

A cosmetic powder is prepared by mixing in a ball mill, 100 grams of talcum powder with 0.25 grams of a perfume composition prepared according to Example III. It has an excellent piney aroma with woody, eucalyptol and minty nuances.

EXAMPLE V

Perfume Liquid Detergent

Concentrated liquid detergents (Lysine salt of n-dodecylbenzene sulfonic acid as more specifically described in U.S. Pat. No. 3,948,818, issued on Apr. 6, 1976) with eucalyptol-like, woody and minty aroma nuances are prepared containing 0.10%, 0.15%, 0.20%, 0.25%, 0.30% and 0.35% of the fragrance prepared according to Example III. They are prepared by adding and homogeneously mixing the appropriate quantity of fragrance formulation prepared according to Example III in the liquid detergent. The detergents all possess excellent piney aromas with woody, eucalyptol-like and minty undertones, the intensity increasing with greater concentrations of perfume composition of Example III.

EXAMPLE VI

Preparation of a Cologne and Handkerchief Perfume

The composition prepared according to Example III is incorporated into a cologne at concentrations of 2.0%, 2.5%, 3.0%, 3.5%, 4.0%, 4.5% and 5.0% in 75%, 80%, 85% and 90% aqueous food grade ethanol; and into a handkerchief perfume at concentrations of 15%, 20%, 25% and 30% (in 90% and 95% aqueous food grade ethanol). A distinctive and definite eucalyptol, woody, minty and piney aroma is imparted to the cologne and to the handkerchief perfume at all levels indicated above.

EXAMPLE VII

Preparation of Soap Composition

One hundred grams of soap chips (IVORY®, produced by the Procter & Gamble Company, Cinncinati, Ohio) are mixed with one gram of the formulation of Example III until homogeneous compositions are obtained. In each of the cases, the homogeneous compositions are heated under three atmospheres pressure at 180° C. for a period of three hours and the resulting liquids are placed into soap molds. The resulting soap cakes, on cooling, manifest excellent eucalyptol-like, woody and minty aromas with an emphasis on the piney aspects of the aroma.

EXAMPLE VIII

Preparation of Solid Detergent Compositions

A detergent is prepared from the following ingredients according to Example I of Canadian Pat. No. 1,007,948:

| Ingredient | Percent by Weight |
|---|---|
| "Neodol ® 45-11 (a $C_{14}$–$C_{15}$ Alcohol ethoxylated with 11 moles of ethylene oxide | 12 |
| Sodium carbonate | 55 |
| Sodium citrate | 20 |
| Sodium sulfate, water brighteners | q.s. |

"This detergent is a "phosphate-free" detergent. A total of 100 grams of said detergent is admixed with 0.10, 0.15, 0.20 and 0.25 grams of the pine perfume of Example III. The detergent sample has an excellent, woody, eucalyptol-like, minty and piney aroma.

EXAMPLE IX

Preparation of a Cosmetic Powder Composition

A cosmetic powder is prepared by admixing in a ball mill, 100 grams of talcum powder with 0.25 grams of one of the di-isoamylene epoxide compound mixture prepared according to Example II. The resulting cosmetic powder has an excellent eucalyptol-like, woody and minty aroma.

EXAMPLE X

Perfume Liquid Detergent

Concentraed liquid detergents (Lysine salt of n-dodecylbenzene sulfonic acid as more specifically described in U.S. Pat. No. 3,948,818, issued on Apr. 6, 1976) with eucalyptol-like, woody and minty aroma notes are prepared containing 0.10%, 0.15%, 0.20% and 0.25% of one or more of the di-isoamylene epoxides prepared according to Example II. They are prepared by adding and homogeneously mixing the appropriate quantity of di-isoamylene epoxide composition is liquid detergent. The detergents all possess eucalyptol-like, woody and minty aroma nuances, the intensity of each characteristic increasing with greater concentrations of di-isoamylene composition of Example II.

EXAMPLE XI

Preparation of Colognes and Handkerchief Perfumes

The di-isoamylene epoxide derivatives prepared according to Example II are incorporated into colognes at concentrations of 2.0%, 2.5%, 3.0%, 4.0% and 4.5% in 85% aqueous food grade ethanol; and into handkerchief perfumes at concentrations of 15%, 20%, 25% and 30% (in 80%, 85%, 90% and 95% aqueous ethanol solutions). Distinctive eucalyptol-like, woody and minty aroma nuances are imparted to the colognes and to the handkerchief perfumes at various levels indicated above.

EXAMPLE XII

Utilizing the procedure of Example I at column 15 of U.S. Pat. No. 3,632,396, a nonwoven cloth substrate useful as a dryer-added fabric-softening article of manufacture is prepared wherein the substrate, the substrate coating and the outer coating and the perfuming material are as follows:

1. A water "dissolvable" paper ("Dissolvo Paper").
2. Adogen 448 (m.p. about 140° F.) as the substrate coating; and
3. An outer coating having the following formulation (m.p. about 150° F.):
   57 percent $C_{20-22}$ HAPS
   22 percent isopropyl alochol
   20 percent antistatic agent
   1 percent of one or more of the di-isoamylene epoxide derivatives of Example II.

Fabric-softening compositions eucalypol-like, woody and minty aroma characteristics essentialy consist of a substrate having a weight of about 3 grams per 100 square inches; a substrate coating having a weight of about 1.85 grams per 100 square inches of substrate; and an outer coating having a weight of about 1.4 grams per 100 square inches of substrate, thereby providing a total aromatized substrate and outer coating weight ratio of about 1:1 by weight of the substrate. The woody, eucalyptol and minty aroma is imparted in a pleasant manner to the head space in the dryer on operation thereof, using the said dryer-added fabric softening nonwoven fabric.

In the following examples, Aromox ® DMC-W and Aromox ® DMMC-W are 30% aqueous solutions of dimethyl cocoamine oxide; and Aromox ® NCMDW is a 40% aqueous solution of N-cocomorpholine oxide produced by Armac Division of AKZO of Chicago, Illinois.

EXAMPLE XIII

Four drops of one or a mixture of the di-isoamylene epoxide compositions prepared according to Example II is added to 2 grams of Aromox ® DMC-W to produce a clear premix. The clear premix is added to 200 grams of CLOROX ® with stirring resulting in a clear stable single phase solution. Sufficient 1M aqueous NaOH is added to bring the pH of the mixture up to 12.8. The solution remains substantially stable at 120° F. for a period of seven days. When the 5% aqueous sodium hypochlorite solution is used as a laundry bleach, the resulting laundry on dry-out in an atmosphere of 65% relative humidity yields substantially no characteristic "hypochlorite" odor but does have a faint pleasant "woody/eucalyptol-like/minty" aroma. Furthermore, no such characteristic "hypochlorite" aroma is retained on the hands of the individual handling such laundry in both the wet and the dry states.

EXAMPLE XIV

Aromox ® DMMC-W in various quantities is mixed with 0.1 gram of one or a mixture of the di-isoamylene epoxide compositions prepared according to Example II. The resulting premixes are then added to 200 grams of an aqueous 5% sodium hypochlorite solution. Sufficient 12.5M aqueous NaOH is added to bring the pH of the mixture up to 13. The following results are obtained:

| Percentage Aromox DMMC-W | Clarity of hypochlorite solution after addition of premix |
|---|---|
| 0.23% | Clear after three days |
| 0.15% | Clear after three days |
| 0.08% | Initially slightly turbid; two phases exist after three days. |

When the 5% aqueous sodium hypochlorite solutions are used as laundry bleaches, the resulting laundry batches on dry-out in an atmosphere of 65% relative humidity yields substantially no characteristic "hypochlorite" odor, but do have faint, pleasant "woody/eucalyptol/minty" aromas. Furthermore no such characteristic "hypochlorite" aroma is retained on the hands of the individual handling such laundry batches in both the wet and the dry states.

EXAMPLE XV

Two grams of Aromox ® DMMC-W are admixed with eight drops of one or a mixture of the di-isoamylene epoxide compositions prepared according to Example II. Each of the premix is then added with stirring to 200 grams of a 7% aqueous solution of lithium hypochlorite. Sufficient 3M aqueous LiOH is added to bring the pH of the solution to 13.4. The mixtures are then heated to 120° F. and maintained at that temperature with stirring for a period 1 week. The resulting solution remains clear in a single phase. When used as laundry bleaches, the resulting bleached laundry batches on dry-out in an atmosphere of 50% relative humidity retain a "woody, eucalyptol-like, minty" aroma; whereas without the use of the one or more di-isoamylene epoxides prepared according to Example II, the bleached laundry batches have faint characteristics disagreeable "hypochlorite" aroma.

EXAMPLE XVI

Two grams of Aromox ® DMMC-W are admixed with eight drops of one or a mixture of the di-isoamylene epoxide compositions produced according to Example II. The premixes are then added with stirring to 200 grams of a mixture containing 4.5% aqueous sodium hypochlorite and 4.5% aqueous lithium hypochlorite. Sufficient 4M aqueous LiOH is added to bring the pH of the solutions to 13.4. The mixtures are then heated to 120° F. and maintained at that temperature for a period of one week. The resulting solutions remain clear in a single phase. When used as laundry bleaches, the resulting bleached laundry batches on dry-out in an atmosphere of 50% relative humidity retain a "woody, eucalyptol-like and minty" aroma; whereas without the use of the di-isoamylene epoxide(s) prepared according to Example II, the bleached laundry batches have faint characteristic disagreeable "hypochlorite" aroma.

EXAMPLE XVII

Two grams of Aromox ® DMMC-W are admixed with eight drops of one or a mixture of di-isoamylene epoxide products produced according to Example II. These premixes are then added with stirring to 200 grams of mixture containing 4% aqueous sodium hypochlorite and 4% aqueous lithium hypochlorite. Sufficient 2M aqueous NaOH is added to bring the pH of the solutions to 13.4. The mixtures are then heated to 110° F. and maintained at that temperature with stirring for a period of 2 weeks. The resulting solutions remain clear as a single phase when used as laundry bleaches. The resulting bleached laundry batches on dry-out in an atmosphere of 50% relative humidity retain a woody, eucalyptol-like, minty aroma; whereas without the use of the di-isoamylene epoxide compositions of Example II the bleached laundry batches have faint characteristic diagreeable "hypochlorite" aroma.

EXAMPLE XVIII

Four drops of one or a mixture di-isoamylene epoxide products produced according to Example II are added to 1.5 grams of Aromox ® NCMDW to produce a clear premix. The clear premix is added to 200 grams of CLOROX ® with stirring resulting in a clear stable single phase solution. Sufficient 1M aqueous NaOH is added to bring to pH to the mixture up to 12.8. The solution remains substantially stable at 120° F. for a period of 7 days. When the 5% aqueous sodium hypochlorite solution is used as a laundry bleach, the resulting laundry on dry-out in an atmosphere of 65% relative humidity yields substantially no characteristic "hypochlorite" odor but does have a faint pleasant "woody, eucalyptol-like, minty" aroma. Furthermore, no such characteristic "hypochlorite" aroma is retained on the hands of the individual handling such laundry in both the wet and the dry states.

EXAMPLE XIX

Four drops of one or a mixture of the di-isoamylene epoxide product produced according to Example II, is added to 1 gram of n-undecyl dimethyl amine oxide to produce a clear premix. The clear premix is added to 200 grams of CLOROX® with stirring resulting in a clear stable single phase solution. Sufficient 1M aqueous NaOH is added to bring the pH of the mixture to 12.8. The solution remains substantially stable at 120° F. for a period of 7 days. When the 5% aqueous sodium hypochlorite solution is used as a laundry bleach the resulting laundry on dry-out in an atmosphere of 65% relative humidity yields substantially no characteristic "hypochlorite" odor but does have a faint pleasant "woody, eucalyptol-like, minty" aroma. Furthermore, no such characteristic "hypochlorite" aroma is retained on the hands of the individual handling such laundry in both the wet and the dry states.

EXAMPLE XX

Four drops of one or a mixture of the di-isoamylene expoxide products produced according to Example II is added to 1 gram of n-dodecyl dimethyl amine oxide to produce a clear premix. The clear premix is added to 200 grams of CLOROX® with stirring resulting in a clear stable single phase solution. Sufficient 1M aqueous NaOH is added to bring the pH of the mixture up to 12.8. The solution remains substantially stable at 120° F. for a period of 7 days. When the 5% aqueous sodium hypochlorite solution is used as a laundry bleach, the resulting laundry on dry-out in an atmosphere of 65% relative humidity yields substantially no characteristic "hypochlorite" odor but does have a faint pleasant "woody, eucalyptol-like, minty" aroma. Furthermore, no such characteristic "hypochlorite" aroma is retained on the hands of the individual handling such laundry in both the wet and the dry states.

EXAMPLE XXI

One gram of n-tridecyl dimethyl amine oxide is admixed with eight drops of one or a mixture of the di-isoamylene epoxide compositions of Example II. This premix is then added with stirring to 200 grams of a 7% aqueous solution of lithium hypochlorite. Sufficient 3M aqueous LiOH is added to bring the pH of the solution to 13.4. The mixture is then heated to 120° F. and maintained at that temperature with stirring for a period of one week. The resulting solution remains clear in a single phase. When used as a laundry bleach, the resulting bleached laundry on dry-out in an atmosphere of 50% relative humidity retains a "woody, eucalyptol-like, minty" aroma; whereas without the use one or the mixture of the di-isoamylene eposide compositions of Example II the bleach laundry has a faint characteristic disagreeable "hypochlorite" aroma.

EXAMPLE XXIIA

Aromox® DMMC-W in various quantities is mixed with 0.1 gram of one of the diisoamylene epoxide compositions prepared according to Example II. The resulting premixes are then added to 200 grams of an aqueous 5% sodium hypochlorite solution. Sufficient 12.5M aqueous NaOH is added to bring the pH of the mixture up to 13. The following results are obtained:

| Percentage Aromox® DMMC-W | Clarity of hypochlorite solution after addition of premix |
|---|---|
| 0.23% | Clear after three days |
| 0.15% | Clear after three days |
| 0.08% | Initially slightly turbid; two phases exist after three days. |

When used as laundry bleaches, the resulting bleached laundries on dry-out in an atmosphere of 50% relative humidity in each of the three cases above retain a "woody", "eucalyptol-like", "minty" aroma whereas without the use of at least one of the diisoamylene epoxide derivatives prepared according to Example II the bleached laundry has a faint characteristic disagreeable hypochlorite aroma.

EXAMPLE XXIIB

Dowfax® 2A1 (see Note 1, infra) in various quantities, as set forth below, is mixed with 0.1 gram of one of the diisoamylene epoxide compositions prepared according to Example II. The resulting premixes are then added to 200 grams of an aqueous 7% sodium hypochlorite solution. Sufficient 12.5 M aqueous NaOH is added to bring the pH of the mixture up to 13.5. The following results are obtained:

| Percentage of DOWFAX® 2A1 | Clarity of hypochlorite solution after addition of premix |
|---|---|
| 0.23% | Clear after seven days |
| 0.15% | Clear after five days |
| 0.08% | Clear after three days |
| 0.01% | Initially slightly turbid; two phases exist after three days. |

FIG. 8A represents a graph of percent residual chlorine versus time in hours for hypochlorite solutions containing DOWFAX® 2A1 (a registered trademark of the Dow Chemical Company of Midland, Michigan) identifying the compound having the structure:

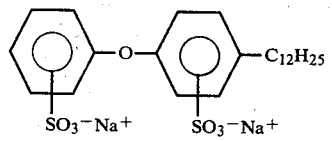

wherein the $C_{12}H_{25}$ moiety is branched chain and the $SO_3^-Na^+$ moieties are at various positions on each of the benzene rings. or AROMOX® DMMC-W, a 30% aqueous solution of dimethylcocoamine oxide having the structure:

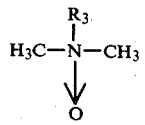

a trademark of Akzo Corporation of Chicago, Illinois (product produced by Armac, Division of Akzo Corporation of Chicago, Illinois) with the ratio of AROMOX® DMMC-W:base being 0.8:99 and the ratio of DOWFAX® 2A1:base being 0.8:99.

FIG. 8B is a graph of percent residual chlorine versus time in hours for hypochlorite solutions of (1) DOWFAX ® 2A1 and AROMOX ® DMMC-W in the absence of fragrance or essential oils with the weight ratios of AROMOX ® DMMC-W:base being 1.8:99 and 3.8:96 and the weight ratios of DOWFAX ® 2A1:-base being 1.8:99 and 3.8:99.

FIG. 9A is a graph of percent residual chlorine versus time in hours comparing hypochlorite solutions of DOWFAX ® 2A1 versus AROMOX ® DMMC-W with the perfuming material being one of the diisoamylene epoxide products produced according to Example II, wherein the weight ratio of AROMOX ® DMMC-W:diisoamylene epoxide:base is either 0.8:0.2:9 or 1.8:0.2:9 and the weight ratio of DOWFAX ® 2A1:-diisoamylene epoxide:base is 0.8:0.2:9 or 1.8:0.2:9.

FIG. 9B is a graph of percent residual chlorine versus time in hours comparing the performance of hypochlorite solutions containing (i) DOWFAX ® 2A1 versus (ii) AROMOX ® DMMC-W using a diisoamylene epoxide product produced according to Example II or not using any fragrance or essential oils with the weight ratio of AROMOX ® DMMC-W:diisoamylene epoxide:base being 3.8:0.2:9 and the ratio of DOWFAX ® 2A1:diisoamylene epoxide:base being 3.8:0.2:9.

Note 1: Dowfax ® 2A1 is a material consisting essentially of a mixture of compounds defined according to the structure:

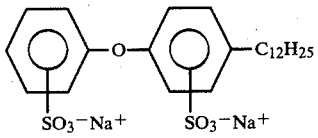

wherein the $C_{12}H_{25}$ moiety is branched chain and the $SO_3-Na^+$ moieties are at various positions on each of the benzene rings.

EXAMPLE XXIII

Dowfax ® 3B2 (see Note 2, infra) in various quantities, as set forth below, is mixed with 0.1 gram of one of the diisoamylene epoxide compositions prepared according to Example II. The resulting premixes are then added to 200 grams of an aqueous 7% sodium hypochlorite solution. Sufficient 12.5 M aqueous NaOH is added to bring the pH of the mixture up to 13.5. The following results are obtained:

| Percentage of DOWFAX ® 2Al | Clarity of hypochlorite solution after addition of premix |
|---|---|
| 0.23% | Clear after seven days |
| 0.15% | Clear after five days |
| 0.08% | Clear after three days |
| 0.01% | Initially slightly turbid; two phases exist after three days. |

When the 7% aqueous sodium hypochlorite solutions are used as laundry bleaches, the resulting laundry batches on dry-out in an atmosphere of 65% relative humidity yield substantially no characteristic "hypochlorite" odors but do have faint, pleasant "woody/eucalyptol/minty" aromas. Furthermore, no such characteristic "hypochlorite" aromas are retained on the hands of the individuals handling such laundry batches in both the wet and the dry states.

Note 2: Dowfax ® 3B2 is a mixture of compounds essentially defined according to the structure:

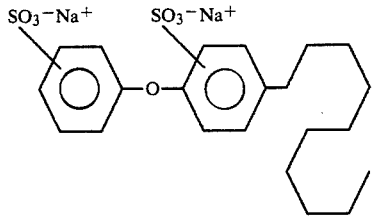

wherein the $SO_3-Na^+$ moieties are at various positions on the phenyl moieties. Dowfax ® 3B2 is a registered trademark of the Dow Chemical Company of Midland, Michigan.

In the following examples, Aromox ® DMC-W and Aromox ® DMMC-W are 30% aqueous solutions of dimethyl cocoamine oxide; and Aromox ® NCMDW is a 40% aqueous solution of N-cocomorpholine oxide produced by Armac Division of AKZO of Chicago, Illinois.

EXAMPLE XXIV

Four drops of one of the diisoamylene epoxide compositions prepared according to Example II is added to two grams of Dowfax ® 3B2 and 0.5 grams of Aromox ® DMC-W to produce a clear premix. The clear premix is added to 200 grams of CLOROX ® with stirring resulting in a clear stable single phase solution. Sufficient 1M aqueous NaOH is added to bring the pH of the mixture up to 12.8. The solution remains substantially stable at 120° F. for a period of seven days. When the 5% aqueous sodium hypochlorite solution is used as a laundry bleach, the resulting laundry on dry-out in an atmosphere of 65% relative humidity yields substantially no characteristic "hypochlorite" odor but does have a faint pleasant "woody/minty/eucalyptol-like" aroma. Furthermore, no such characteristic "hypochlorite" aroma is retained on the hands of the individual handling such laundry in both the wet and the dry states.

EXAMPLE XXV

One gram of Dowfax ® 3B2; one gram of Dowfax ® 2A1 and 0.25 grams of Aromox ® DMMC-W is admixed with eight drops of one of the diisoamylene epoxide compositions of Example II. This premix is then added, with stirring to 200 grams of a mixture containing 4.5% aqueous sodium hypochlorite and 4.5% aqueous lithium hypochlorite. Sufficient 4 M aqueous LiOH is added to bring the pH of the solution to 13.4. The mixture is then heated to 120° F. and maintained at that temperature for a period of one week. The resulting solution remains clear in a single phase. When used as a laundry bleach, the resulting bleached laundry on dry-out in an atmosphere of 50% relative humidity retains a woody, minty, eucalyptol-like aroma; whereas without the use of one of the diisoamylene epoxide products prepared according to Example II, the bleached laundry has a faint characteristic disagreeable "hypochlorite" aroma.

EXAMPLE XXVI

One gram of Dowfax ® 2A1 and one gram of Dowfax ® 3B2 is admixed with eight drops of one of the diisoamylene epoxide compositions of Example II. This premix is then added, with stirring to 200 grams of a mixture containing 4.5% aqueous sodium hypochlorite. Sufficient 4 M aqueous LiOH is added to bring the pH of the solution to 13.4. The mixture is then heated to 120° F. and maintained at that temperature for a period of one week. The resulting solution remains clear in a single phase. When used as a laundry bleach, the resulting bleached laundry on dry-out in an atmosphere of 50% relative humidity retains a "clean fresh", woody, minty, eucalyptol aroma; whereas without the use of one of the diisoamylene epoxide products prepared according to Example II the bleached laundry has a faint characteristic disagreeable "hypochlorite" aroma.

EXAMPLE XXVII 1.5 grams of Dowfax® 2A1 is admixed with eight drops of one of the diisoamylene epoxide products produced according to Example II. This premix is then added with stirring to 200 grams of a mixture containing 4.5% aqueous sodium hypochlorite and 4.5% aqueous lithium hypochlorite. Sufficient 2 M aqueous NaOH is added to bring the pH of the solution to 13.4. The mixture is then heated to 110° F. and maintained at that temperature with stirring for a period of 2 weeks. The resulting solution remains clear as a single phase when used as a laundry bleach. The resulting bleached laundry, on dry-out in an atmosphere of 50% relative humidity, retains a "woody, minty, eucalyptol-like" aroma whereas without the use of one of the diisoamylene epoxide compositions of Example II, the bleached laundry has a faint characteristic disagreeable "hypochlorite" aroma.

EXAMPLE XXVIII

Four drops of one of the diisoamylene epoxide mixtures produced according to Example II, is added to 1.0 gram of Dowfax® 3B2 and 0.25 grams of Aromox® NCMDW to produce a clear premix. The clear premix is added to 200 grams of CLOROX® with stirring resulting in a clear stable single phase solution. Sufficient 1 M aqueous NaOH is added to bring the pH of the mixture up to 12.8. The solution remains substantially stable at 120° F. for a period of 7 days. When the 5% aqueous sodium hypochlorite solution is used as a laundry bleach, the resulting laundry on dry-out in an atmosphere of 65% relative humidity yields substantially no characteristic "hypochlorite" odor but does have a faint pleasant "woody, minty, eucalyptol-like" aroma. Furthermore, no such characteristic "hypochlorite" aroma is retained on the hands of the individual handling such laundry in both the wet and the dry states.

EXAMPLE XXIX

Four drops of one of the diisoamylene epoxide mixtures produced according to Example II, is added to 0.1 gram n-undecyl dimethyl amine oxide and 0.9 grams of Dowfax® 3B2 to produce a clear premix. The clear premix is added to 200 grams of CLOROX® with stirring resulting in a clear stable single phase solution. Sufficient 1 M aqueous NaOH is added to bring the pH of the mixture up to 12.8. The solution remains substantially stable at 120° F. for a period 7 days. When the 5% aqueous sodium hypochlorite solution is used as a laundry bleach, the resulting laundry on dry-out in an atmosphere of 65% relative humidity yields substantially no characteristic "hypochlorite" odor but does have a faint pleasant "woody, minty, eucalyptol-like" aroma. Furthermore, no such characteristic "hypochlorite" aroma is retained on the hands of the individual handling such laundry in both the wet and the dry states.

EXAMPLE XXX

Four drops of one of the diisoamylene epoxide mixtures produced according to Example II is added to 0.1 gram of n-dodecyl dimethyl amine oxide and 0.9 grams of Dowfax® 2A1 to produce a clear premix. The clear premix is added to 200 grams of CLOROX® with stirring resulting in a clear stable single phase solution. Sufficient 1 M aqueous NaOH is added to bring the pH of the mixture up to 12.8. The solution remains substantially stable at 120° F. for a period of 7 days. When the 5% aqueous sodium hypochlorite solution is used as a laundry bleach, the resulting laundry on dry-out in an atmosphere of 65% relative humidity yields substantially no characteristic "hypochlorite" odor but does have a faint pleasant "woody, minty, eucalyptol-like" aroma. Furthermore, no such characteristic "hypochlorite" aroma is retained on the hands of the individual handling such laundry in both the wet and the dry states.

EXAMPLE XXXI 0.2 grams of n-tridecyl dimethyl amine oxide and 0.7 grams of Dowfax® 3B2 are admixed with eight drops of one of the diisoamylene epoxide compositions of Example II. This premix is then added with stirring to 200 grams of a 7% aqueous solution of lithium hypochlorite. Sufficient 3 M aqueous LiOH is added to bring the pH of the solution to 13.4. The mixture is then heated to 120° F. and maintained at that temperature with stirring for a period of one week. The resulting solution remains clear in a single phase. When used as a laundry bleach, the resulting bleached laundry on dry-out in an atmosphere of 50% relative humidity retains a "clean fresh, woody, minty, eucalyptol-like" aroma; whereas without the use of the diisoamylene epoxide compositions of Example II, the bleach laundry has a faint characteristic disagreeable "hypochlorite" aroma.

EXAMPLE XXXII

A mixture is prepared consisting of 39 grams Dowfax® 2A1 (60.75%); 4.5 grams sodium palmitate (7.00%); and 20.7 grams of water (32.25%). The mixture is heated while stirring followed by ultrasonic dispersion thereby yielding a homogeneous gel. 64.2 grams of this material is used as follows: 4 drops of one of the diisoamylene epoxide mixtures produced according to Example II is added to 2.0 grams of the foregoing gel to produce a clear premix. The clear premix is added to 200 grams of CLOROX® with stirring resulting in a clear stable single phase solution. Sufficient 1 M aqueous NaOH is added to bring the pH of the mixture up to 12.8. The solution remains substantially stable at 120° F. for a period of 7 days. When the 5% aqueous sodium hypochlorite solution is used as a laundry bleach, the resulting laundry on dry-out in an atmosphere of 65% relative humidity yields substantially no characteristic "hypochlorite" odor but does have a faint pleasant "woody, minty, eucalyptol-like" aroma. Furthermore, no such characteristic "hypochlorite" aroma is retained on the hands of the individual handling such laundry in both the wet and the dry states.

EXAMPLE XXXIII

A mixture is prepared consisting of 39 grams Dowfax® 2A1 (60.75%); 4.5 grams sodium laurate (7.00%); and 20.7 grams of water (32.25%). The mixture is heated while stirring followed by ultrasonic dispersion thereby yielding a homogeneous gel. 64.2 grams of this material is used as follows: 4 drops of one of the diisoamylene epoxide mixtures produced according to Example II is added to 2.0 grams of the foregoing gel to produce a clear premix. The clear premix is added to 200 grams of CLOROX® with stirring resulting in a clear stable single phase solution. Sufficient 1 M aqueus NaOH is added to bring the pH of the mixture up to 12.8. The solution remains substantially stable at 120° F. for a period of 7 days. When the 5% aqueous sodium hypochlorite solution is used as a laundry bleach, the resulting laundry on dry-out in an atmosphere of 65% relative humidity yields substantially no characteristic "hypochlorite" odor but does have a faint pleasant "woody, minty, eucalyptol-like" aroma. Furthermore, no such characteristic "hypochlorite" aroma is retained on the hands of the individual handling such laundry in both the wet and the dry states.

EXAMPLE XXXIV

A mixture is prepared consisting of 20.1 grams Dowfax® 2A1 (60.75%); 2.0 grams sodium palmitate (7.00%); and 20.0 grams of water (32.25%). The mixture is heated while stirring followed by ultrasonic dispersion thereby yielding a homogeneous gel. 64.2 grams of this material is used as follows: 4 drops of one of the diisoamylene epoxide mixtures produced according to Example II is added to 2.0 grams of the foregoing gel to produce a clear premix. The clear premix is added to 200 grams of CLOROX® with stirring resulting in a clear stable single phase solution. Sufficient 1 M aqueous NaOH is added to bring the pH of the mixture up to 12.8. The solution remains substantially stable at 120° F. for a period of 7 days. When the 5% aqueous sodium hypochlorite solution is used as a laundry bleach, the resulting laundry on dry-out in an atmosphere of 65% relative humidity yields substantially no characteristic "hypochlorite" odor but does have a faint pleasant "woody, minty, eucalyptol-like" aroma. Furthermore, no such characteristic "hypochlorite" aroma is retained on the hands of the individual handling such laundry in both the wet and the dry states.

EXAMPLE XXXV

A mixture is prepared consisting of 20.1 grams Dowfax® 2A1 (60.75%); 2.0 grams sodium laurate (7.00%); and 20.0 grams of water (32.25%). The mixture is heated while stirring followed by ultrasonic dispersion thereby yielding a homogeneous gel. 64.2 grams of this material is used as follows: 4 drops of one of the diisoamylene epoxide mixtures produced according to Example II is added to 2.0 grams of the foregoing gel to produce a clear premix. The clear premix is added to 200 grams of CLOROX® with stirring resulting in a clear stable single phase solution. Sufficient 1 M aqueous NaOH is added to bring the pH of the mixture up to 12.8. The solution remains substantially stable at 120° F. for a period of 7 days. When the 5% aqueous sodium hypochlorite solution is used as a laundry bleach, the resulting laundry on dry-out in an atmosphere of 65% relative humidity yields substantially no characteristic "hypochlorite" odor but does have a faint pleasant "woody, minty, eucalyptol-like" aroma. Furthermore, no such characteristic "hypochlorite" aroma is retained on the hands of the individual handling such laundry in both the wet and the dry states.

EXAMPLE XXXVI

A mixture is prepared consisting of 10 grams Dowfax® 2A1 and 10 grams Dowfax® 3B2 (60.75%); and 2.0 grams sodium laurate (7.00%); and 20.0 grams of water (32.25%). The mixture is heated while stirring followed by ultrasonic dispersion thereby yielding a homogeneous gel. 64.2 grams of this material is used as follows: 4 drops of one of the diisoamylene epoxide mixtures produced according to Example I is added to 2.0 grams of the foregoing gel to produce a clear premix. The clear premix is added to 200 grams of CLOROX® with stirring resulting in a clear stable single phase solution. Sufficient 1 M aqueous NaOH is added to bring the pH of the mixture up to 12.8. The solution remains substantially stable at 120° F. for a period of 7 days. When the 5% aqueous sodium hypochlorite solution is used as a laundry bleach, the resulting laundry on dry-out in an atmosphere of 65% relative humidity yields substantially no characteristic "hypochlorite" odor but does have a faint pleasant "woody, minty, eucalyptol-like" aroma. Furthermore, no such characteristic "hypochlorite" aroma is retained on the hands of the individual handling such laundry in both the wet and the dry states.

What is claimed is:

1. An aqueous alkali metal hypochlorite solution comprising as a sole detergent a composition of matter selected from the group consisting of (1) at least one substance defined according to the structure:

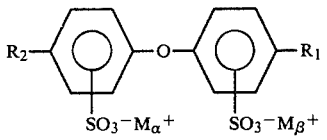

wherein at least one of $R_1$ and $R_2$ is $C_{10}$–$C_{12}$ straight chain or branched chain alkyl; when one of $R_1$ or $R_2$ is $C_{10}$–$C_{12}$ straight chain or branched chain alkyl the other of $R_1$ or $R_2$ is hydrogen; wherein $M_\alpha$ and $M_\beta$ are the same or different and each represents alkali metal selected from the group consisting of sodium, potassium and lithium and (2) a mixture comprising a material having the structure:

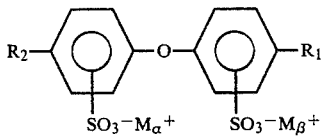

and intimately admixed therewith a substance having the structure:

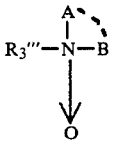

wherein $R_3'''$ is straight chain alkyl; wherein more than 55% of the $R_3'''$ moieties consist of straight chain alkyl having from 11 up to 13 carbon atoms and wherein A and B are each separately methyl or, taken together, complete a morpholine ring; and from 0.02% up to 0.2% of one or more diisoamylene epoxide-containing compositions defined according to the structure:

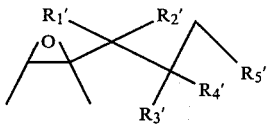

wherein $R_1'$, $R_2'$, $R_3'$, $R_4'$ and $R_5'$ are the same or different and each represents hydrogen or methyl with the proviso that (i) the sum total of carbon atoms in $R_1'$, $R_2'$, $R_3'$, $R_4'$ and $R_5'$ is three, and (ii) $R_1'$ and $R_2'$ represent hydrogen when $R_5'$ represents methyl, and (iii) when either $R_1'$ or $R_2'$ is methyl, $R_5'$ is hydrogen; said diisoamylene epoxide being capable of imparting to said alkali metal hypochlorite solution or to an article to which said alkali metal hypochlorite solution is applied, a woody, eucalyptol-like, minty aroma, hypochlorite solution having a pH of 11 up to 14.0.

2. The composition of claim 1 wherein the compound having the structure:

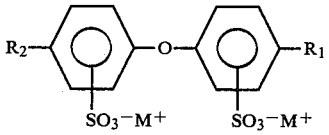

is selected from the group of materials having the structures:

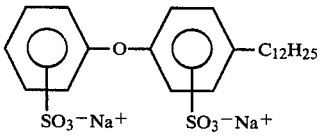

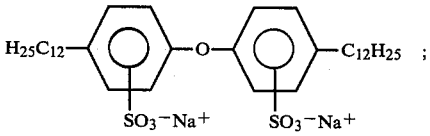

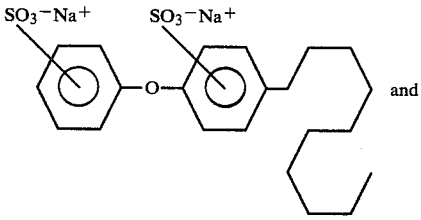

and

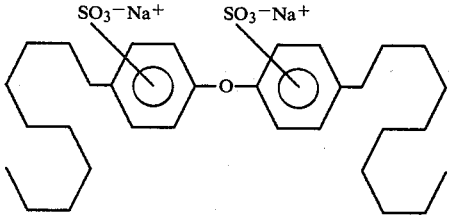

3. A process for producing a stable single phase aqueous alkaline metal hypochlorite solution having a woody, eucalyptol-like, minty fragrance consisting, in sequential order, of the steps of (a) adjusting the pH of an aqueous alkali metal hypochlorite solution to the range of 11–14.0; (b) admixing a composition of matter selected from the group consisting of:

(i) a chemical compound having the structure:

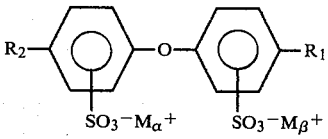

wherein at least one of $R_1$ and $R_2$ is $C_{10}$–$C_{12}$ straight chain or branched chain alkyl and $M_\alpha$ and $M_\beta$ are the same or different and each represents lithium, potassium or sodium and (ii) a mixture of at least one compound having the structure:

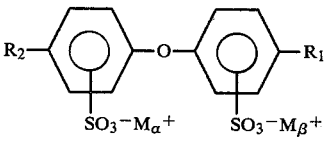

and a compound having the structure

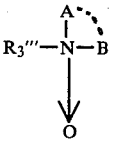

wherein $R_3'''$ is straight chain alkyl; wherein more than 55% of the $R_3'''$ moieties consist of straight chain alkyl having from 11 to 13 carbon atoms and wherein A and B are each separately methyl or taken together complete a morpholine ring with a composition consisting essentially of at least one diisoamylene epoxide defined according to the structure:

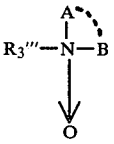

wherein $R_1'$, $R_2'$, $R_3'$, $R_4'$ and $R_5'$ are the same or different and each represents hydrogen or methyl with the proviso that (i) the sum total of carbon atoms in $R_1'$, $R_2'$, $R_3'$, $R_4'$ and $R_5'$ is three, and (ii) $R_1'$ and $R_2'$ represent hydrogen when $R_5'$ represents methyl, and (iii) when either $R_1'$ or $R_2'$ is methyl, $R_5'$ is hydrogen, whereby a premix is formed and (c) adding said premix to the pH adjusted hypochlorite solution.

4. The process of claim 3 comprising the additional step of adding to said premix a gel-forming agent selected from the group consisting or sodium palmitate, lithium palmitate, potassium palmitate, sodium laurate, lithium laurate, potassium laurate, sodium stearate, potassium stearate and lithium stearate.

5. The composition of claim 1 comprising in addition to the ingredients of said composition, a thickening or gel-forming agent selected from the group consisting of sodium laurate, potassium laurate, lithium laurate, sodium palmitate, potassium palmitate, lithium palmitate, sodium stearate, potassium stearate and lithium stearate.

* * * * *